US006195948B1

(12) United States Patent
Lamanna

(10) Patent No.: US 6,195,948 B1
(45) Date of Patent: Mar. 6, 2001

(54) SKYLIGHTS TO ACCOMMODATE ON SITE ADJUSTMENTS FOR VARIATIONS IN INSTALLATIONS

(75) Inventor: Rocco Joseph Lamanna, Vaughan (CA)

(73) Assignee: Poly Lite Windows Ltd., Vaughan (CA)

( * ) Notice: Subject to any disclaimer, the term of this patent is extended or adjusted under 35 U.S.C. 154(b) by 0 days.

(21) Appl. No.: 09/358,644

(22) Filed: Jul. 23, 1999

(51) Int. Cl.[7] ..... E04B 7/18
(52) U.S. Cl. ..... 52/200; 52/60
(58) Field of Search ..... 52/200, 72, 60, 52/62, 656.2

(56) References Cited

U.S. PATENT DOCUMENTS

| | | | |
|---|---|---|---|
| D. 328,353 | | 7/1992 | Yamaguchi et al. . |
| D. 328,354 | | 7/1992 | Hosoyama . |
| 3,127,699 | | 4/1964 | Wasserman . |
| 3,307,309 | | 3/1967 | Bloxsom . |
| 4,080,763 | | 3/1978 | Naidus et al. . |
| 4,117,638 | | 10/1978 | Kidd et al. . |
| 4,242,849 | | 1/1981 | Benkelman et al. . |
| 4,389,823 | | 6/1983 | Player . |
| 4,409,767 | | 10/1983 | Jentoft et al. . |
| 4,439,962 | | 4/1984 | Jentoft et al. . |
| 4,520,604 | | 6/1985 | Halsey et al. . |
| 4,543,753 | | 10/1985 | Sonneborn et al. . |
| 4,589,238 | | 5/1986 | Sampson et al. . |
| 4,621,466 | | 11/1986 | Sonneborn et al. . |
| 4,649,680 | | 3/1987 | Weisner et al. . |
| 4,757,655 | | 7/1988 | Jentoft et al. . |
| 4,833,838 | | 5/1989 | Van Dame . |
| 4,860,511 | | 8/1989 | Weisner et al. . |
| 4,995,208 | | 2/1991 | Sampson et al. . |
| 5,044,133 | * | 9/1991 | Sampson et al. ..... 52/200 X |
| 5,046,292 | | 9/1991 | Sampson et al. . |
| 5,148,643 | | 9/1992 | Sampson et al. . |
| 5,207,036 | | 5/1993 | Sampson et al. . |
| 5,394,664 | | 3/1995 | Nowell . |
| 5,522,189 | | 6/1996 | Mortensen et al. . |
| 5,544,455 | * | 8/1996 | DeBlock ..... 52/200 |
| 5,553,425 | | 9/1996 | Sampson et al. . |
| 5,596,848 | | 1/1997 | Lynch . |
| 5,617,682 | | 4/1997 | Christopher . |
| 5,718,088 | | 2/1998 | Jacobsen . |
| 5,913,785 | * | 6/1999 | Moller et al. ..... 52/200 |
| 6,052,956 | * | 4/2000 | Hoy et al. ..... 52/200 |

FOREIGN PATENT DOCUMENTS

| | | |
|---|---|---|
| 1286078 | 7/1991 | (CA) . |
| 2005251 | 7/1994 | (CA) . |
| 2165232 | 12/1996 | (CA) . |
| 2127560 | 2/1999 | (CA) . |
| 0 679 778 A1 | 11/1995 | (EP) . |
| 8177177 | 7/1996 | (JP) . |

OTHER PUBLICATIONS

Poly Lite Windows Ltd. Brochure, 1997, pp. 12 and 13.

* cited by examiner

*Primary Examiner*—David M. Purol
(74) *Attorney, Agent, or Firm*—Neil H. Hughes; Ivor M. Hughes; Marcelo K. Sarkis

(57) ABSTRACT

A skylight is disclosed for installation in an opening disposed in the top of an enclosure. The skylight includes framing sections providing for variation in installations and accommodating on site adjustments when fastening and fitting the skylight within the opening of the enclosure. The framing sections are adapted to receive supplementary moldings adapted to friction fit with the framing section which provide for variation in installation tolerances and cover any undesirably exposed portions of the enclosure resulting from installation of the skylight, while accommodating on site adjustments.

15 Claims, 20 Drawing Sheets

SKYLIGHTS TO ACCOMMODATE ON SITE ADJUSTMENTS FOR VARIATIONS IN INSTALLATIONS

FIELD OF INVENTION

This invention relates to skylights and finds particular application to skylights installed on the top of enclosures such as a roof of a house or alternatively on the top of a solarium or the like.

BACKGROUND OF THE INVENTION

Skylights have become more and more popular with new homes or when renovating an older home. Skylights may be installed in the roof of a home or in a solarium, or a sunroom enclosure. When manufacturing skylights it is typical that they are made to fit a particular standard sized opening. The installer, (typically the roofer) for a replacement skylight, must therefore carefully measure the opening in which the skylight will be installed and provide the manufacturer with these dimensions. When creating the opening in a roof, it will be necessary to extend the opening down through an attic and ultimately into the room into which the light is desired. A tunnel therefore, must be formed between the room through the attic and adjacent to the opening in the roof. This tunnel is lined with drywall, or wooden boards, or the like. These boards or drywall extend up to near the roof line and must be accommodated with any skylight installation. In some instances, for example with a curb mount unit, unsightly pockets or steps are created which attract dust and insects. It would be advantageous to be able to make adjustments for manufacturing tolerances at the site, resulting in a better fit and finish of the installation. Heretofore a skylight assembly accommodating installation variations is unknown.

In order to install known skylight assemblies, the installer will insert the skylight into the opening and will be required to enter the home and climb a ladder to access the underside of the skylight to fasten it properly, for example a curb, to adjacent the tunnel area. Most installers are roofers, as window installers normally will not climb onto a roof.

It would be advantageous to provide a skylight assembly which may be installed from the roof only or from the tunnel area only. This will result in a significant amount of labour savings in retrofit installations or maintenance. It would also be advantageous to provide a standardized skylight assembly for retrofit installations which includes a predetermined latitude for adjustment by the installer.

It is therefore a primary object of the invention to provide a skylight assembly which will accommodate variations from installation to installation.

It is a further object of the invention to provide a skylight assembly which may be utilized for installation in a roof of a dwelling, or the same assembly may be utilized for installation in a solarium.

It is yet a further object of the invention to provide standardized cross sections for skylight assemblies for various installations with a curb mount system, a curbless mounting system, and sunroom or solarium installation.

It is yet a further object of the invention to provide a standardized framing section for a skylight assembly which may be used with a curb installation, without a curb installation, and within the solarium by providing removable portions formed with the framing section.

It is yet a further object of the invention to provide a section which may be utilized to interconnect adjacent skylights and provide water shedding capabilities therefore.

Further and other objects of the invention will become apparent to those skilled in the art when considering the following summary of the invention and the more detailed description of the preferred embodiments illustrated herein.

SUMMARY OF THE INVENTION

According to a primary aspect of the invention there is provided a skylight for installation in an opening disposed in the top of an enclosure (such as a roof for a building, i.e. a dwelling, a solarium or the like), comprising framing sections adapted for installation adjacent the opening, said sections providing for variation in installations and accommodating on site adjustments when fastening and fitting the skylight within the opening of the enclosure, said framing sections being adapted to receive supplementary moldings adapted to friction fit with the framing section such as a quick connect and preferably snap on or clip on moldings which provide for variation in installation tolerances and cover any undesirably exposed portions of the enclosure, resulting from installation of said skylight, accommodating on site adjustments.

In one embodiment the moldings are generally "F" shaped in cross section preferably with one leg being trimmable at several positions along the leg to accommodate various thicknesses of drywall, wood or the like forming the tunnel within the enclosure adjacent said opening. In another embodiment the moldings are generally "L" shaped in cross section for abutting the aluminum sheeting proximate the bottom of a solarium ceiling, and at the same time covering any exposed rough edges of metal, foam, or insulation. In another embodiment the molding is generally "J" shaped in cross section and preferably includes a trimmable flange to allow for variation in thickness of drywall, wood or the like forming the tunnel within the enclosure adjacent said opening. The trimmable flanges for both the "F" and "J" shaped cross sectional moldings provide for adjustment to accommodate side to side and end to end variations from installation to installation. By providing with the "J" shaped molding a ⅛ inch adjustment, a total ¼ inch accommodation in side to side and end to end variations is available. Further the "F" shaped molding, can be trimmed to accommodate ½ inch drywall or up to 1 and ¼ inch planks located in the tunnel. This provides for side to side and end to end variations of 1 and ½ inches providing the installer with a lot of latitude.

According to another aspect of the invention there is provided a skylight assembly comprising a main frame for surrounding an opening in a top of an enclosure, such as a "roof" of a dwelling or solarium, said enclosure separating an interior space and an exterior, and having a top, said opening extending from the exterior into the interior space of the enclosure, said main frame including at least one main frame section having a top, a bottom, a first exterior side and a second interior side and two ends, said top of said section for receiving and securing a glass light in cooperation with a separate cap section preferably made of aluminum (in one embodiment said cap being general "F" shaped to avoid excessive loading on the glass while loading adjacent a seal), said bottom of said section for securing to adjacent the top of the enclosure adjacent the opening and in one embodiment to a curb formed adjacent the opening, preferably said top of said section including; a screw port for receiving a fastener, a glass receiving channel, an exterior condensate receiving channel located proximate the first exterior side, an interior condensate receiving channel located proximate the second interior side; preferably said main frame section having a flashing anchoring member disposed proximate the top thereof proximate the first exterior side and preferably a removable flashing portion disposed proximate the bottom of the first exterior side, said removable flashing portion being removed when the skylight is installed without a curb in a solarium, sundeck or the like (thus providing an aesthetically more pleasing installation), preferably the bottom of said frame section having a removable leg provided therewith extending downwardly away from said frame section for abutting one side of the drywall, wooden slats or the like within the tunnel forming the opening when the skylight is installed on a roof or the like, said leg being removable when the skylight is installed in for example a solarium, the main frame section also having a supplementary molding engaging portion disposed proximate the second interior side of the main frame section, and in one embodiment the supplementary molding engaging portion is disposed proximate the top thereof preferably when the frame section has a low profile and includes at least two and preferably three interconnected horizontally disposed subsections (in one embodiment a central subsection is drained to the adjacent subsection to the first exterior side of the section), and in another embodiment proximate the bottom thereof preferably when the frame section has a high profile of at least two and preferably three interconnected vertically disposed subsections, said supplementary molding engaging portion for receiving a supplementary molding adapted to friction fit with the supplementary molding engaging portion of the framing section such as a quick connect and preferably snap on or clip on and for engaging and abutting an opposite interior surface of the drywall, wooden slats or the like engaged by said removable leg, preferably said supplementary molding having a trimmable flange to accommodate variations in dimensions of drywall, wooden slats or the like providing for on site adjustment to variations in wall thickness, wherein said skylight assembly may be used to accommodate for variations from one installation to another, whether the skylight is installed on a roof of a house, enclosure, or the like or alternatively installed in a solarium.

The sections may be made from any suitable material that can be formed to provide the friction fit, quick connect and preferred snap on feature of the supplementary moldings, such as plastics, PVC, fiberglass, aluminum, or the like. This quick connect and preferred snap on feature provides a great deal of labour savings from prior structures requiring cutting, fastening, and fitting. With the present invention allowances for adjustments may be made at the installation obviating the need to carry excessive inventory of trim portions such as "U" or "C" shaped channels and the cutting thereof. With the present assembly a properly finished installation results. The supplementary moldings are utilized to cover up rough cutouts exposing for example rough edges of sheet metal (aluminum) and foam exposed when creating the opening in a solarium, and in another example to cover up exposed drywall or the like used to create the tunnel opening in a roof skylight installation. The installations are self flashing and provide an excellent seal.

In one embodiment the supplementary moldings are generally "F", "L" or "J" shaped and may also include a trimmable appendage extending therefrom to allow for variations from one installation to another.

In another embodiment the supplementary moldings are manufactured to flex, from an angle of slightly less than substantially ninety degrees, to an angle of about ninety degrees to aid in the moldings securing and sealing functions.

The skylight assemblies embodying the invention are preferably manufactured with 16 or 24 inch centers to fit in between structural roof members or alternatively 24 or 36 inch centers for solariums. In some cases the installation may be installed by either the roofer from the top or by a window installer from the bottom providing the builder or contractor with more flexibility in scheduling.

In another embodiment the skylight or skylight assembly may be installed in multiples of at least two skylights or skylight assemblies such as a first and second skylight assembly for preferably over and under installations. In order to accommodate such an installation, a separate generally "L" shaped interconnecting member is provided having a vertical and a horizontal leg and having a smaller leg extending substantially parallel and adjacent to the horizontal leg, said member abutting the exterior of a first skylight assembly proximate the trimmable flange adjacent the bottom of the exterior side, and the second skylight assembly interlocking with the first assembly when the trimmable flange adjacent the bottom of the exterior side of the second skylight assembly is captured between the smaller leg and the horizontal leg of the interconnecting member. Preferably said interconnecting member having grooves and channels to interconnect and capture the trimmable flange. The two assemblies as interconnected provide with the member a "U" shaped channel to allow for drainage. Of course the two assemblies and member are properly flashed and sealed as required. The skylight assembly permits metal flashing to be installed proximate the exterior and being retained by the flashing anchoring member by inserting a flexible retainer between the flashing anchoring member and the flashing.

In another embodiment there is provided an interconnecting member for interconnecting skylights installed in multiples of at least two skylights such as a first and second skylight for over and under installations comprising a generally "L" shaped interconnecting member having a vertical and a horizontal leg and having a smaller leg extending substantially parallel and adjacent to the horizontal leg, said member abutting the exterior of a first skylight proximate a trimmable flange adjacent the bottom of an exterior side, and a second skylight assembly interlocking with the first assembly when a trimmable flange adjacent the bottom of the exterior side of the second skylight assembly is captured between the smaller leg and the horizontal leg of the interconnecting member.

BRIEF DESCRIPTION OF THE DRAWINGS

The following figures illustrate preferred and alternative embodiments of the invention, wherein.

DETAILED DESCRIPTION OF THE PREFERRED EMBODIMENTS

Figure 4:
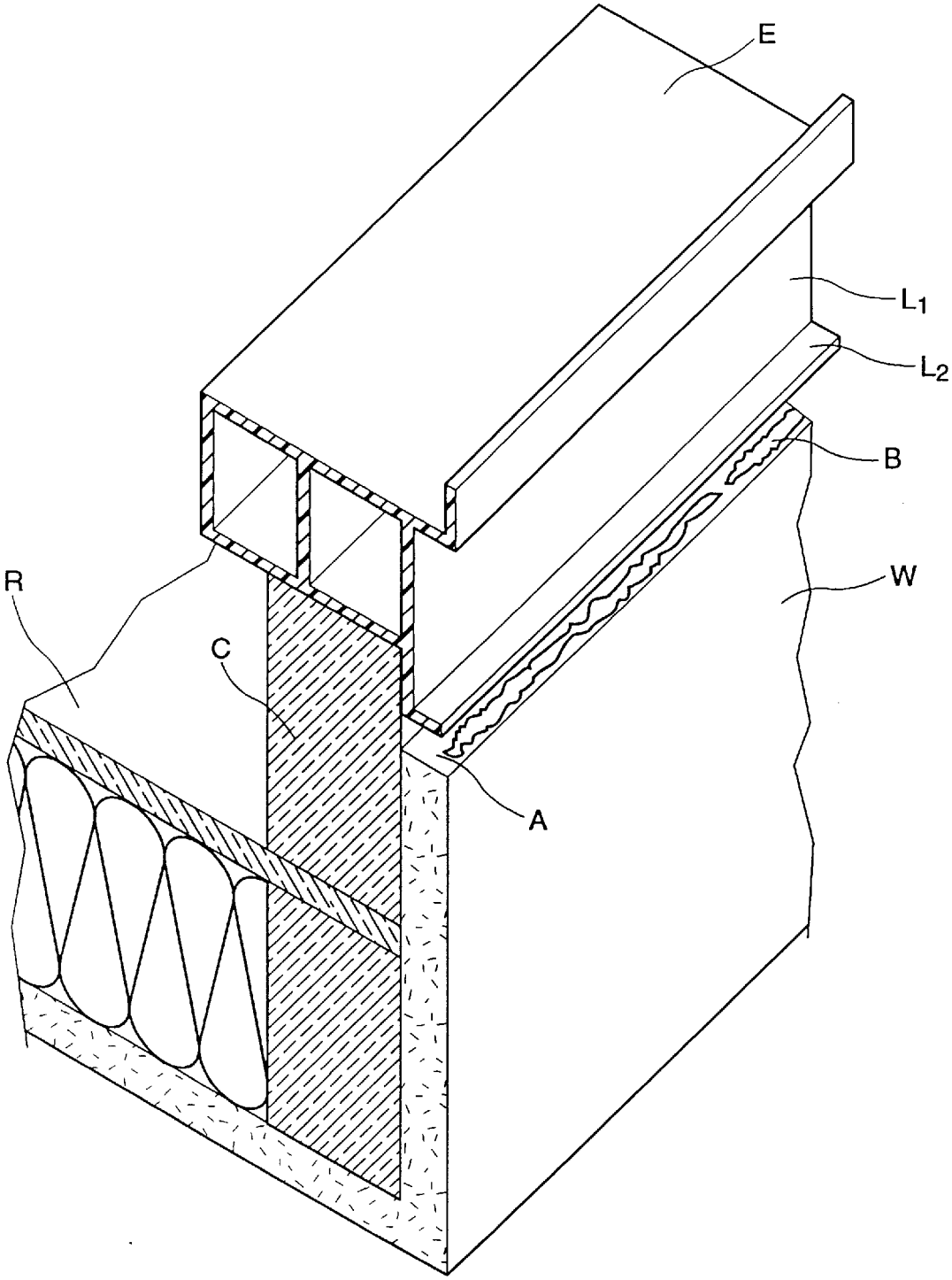
Figure 4 (PRIOR ART)
FIG. 4 represents prior art to the present invention. Further in relation to FIG. 4 by providing such a poor quality finish heat losses around the skylight will result.
Figure 5A:
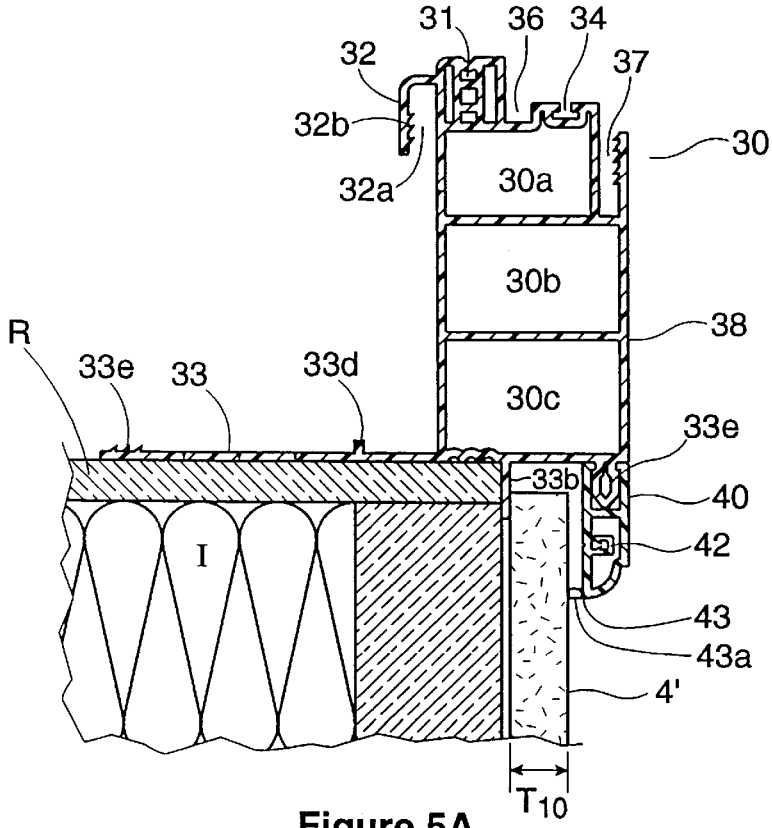
FIGS. 5A and 5B illustrate a sectional end view of the installation of FIGS. 2A through 2D.
Figure 5B:
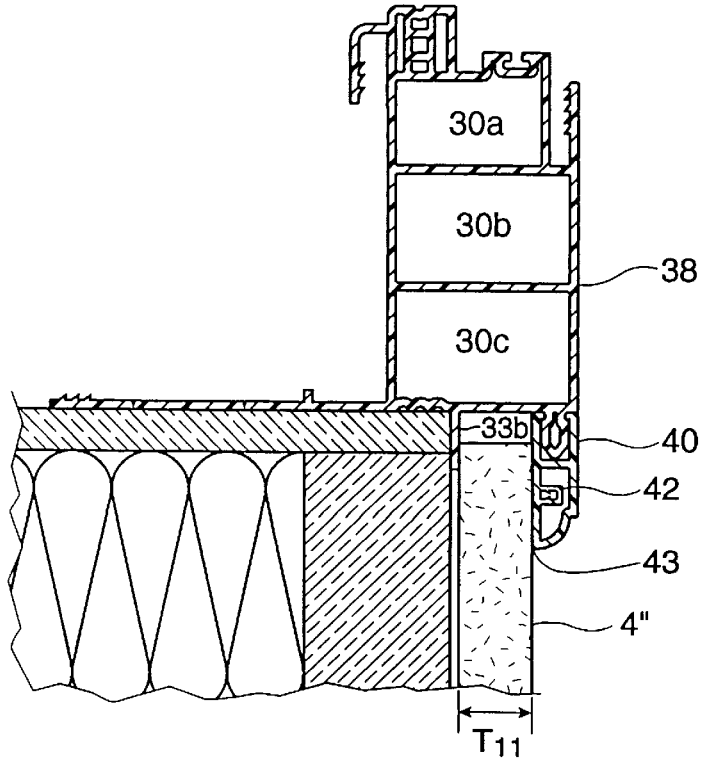

Referring now to FIG. 4 there is illustrated a prior art installation for a skylight sub-assembly including an extrusion "E" installed on a roof or on a typical curb assembly "C" having a member "L1" extending perpendicularly from the top of the extrusion "E" and a ledged portion "L" attempting to cover up the drywall "W". Unfortunately with such an installation, a pocket or step "A" is created where debris, dust and insects "B" accumulates. Edges of the capped drywall "W" are observable by the owner of the skylight installation. It is undesirable to create such a rough finish for an installation and to create such unsanitary conditions. No accommodation is made whatsoever for variations in the drywall thickness. The step at "A" with increased thickness becomes even more prominent. It is therefore an object of the invention to eliminate the debris "B" from accumulating, since the occupant cannot clean this area without a great deal of difficulty. Further the risk of mold accumulating is evident.

Figure 1A:
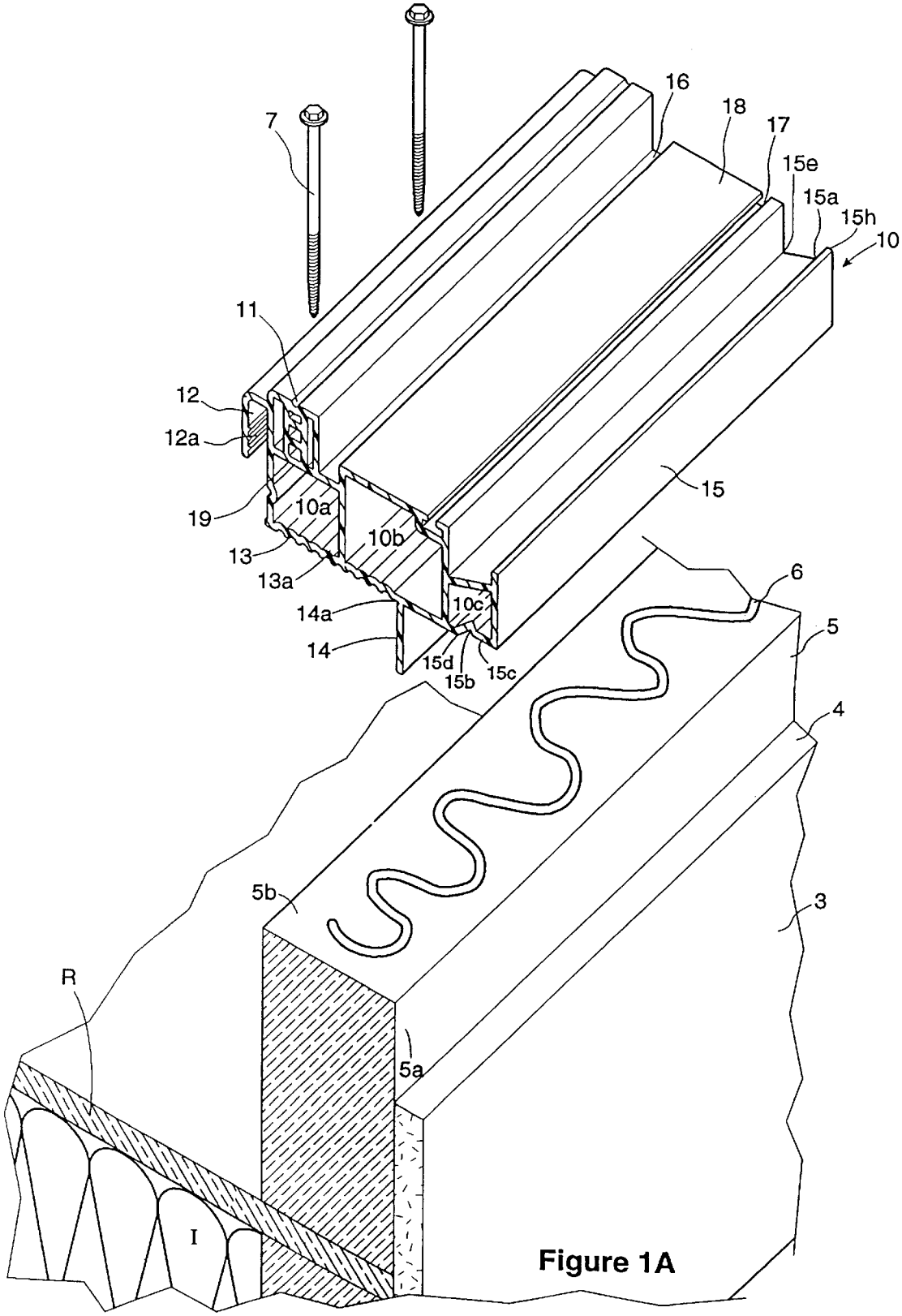
FIGS. 1A through 1E illustrate in perspective a low profile framing section for a skylight assembly and the step by step installation thereof on a preformed curb surrounding the opening in the top of an enclosure and illustrated in a preferred embodiment of the invention.
Figure 1B:
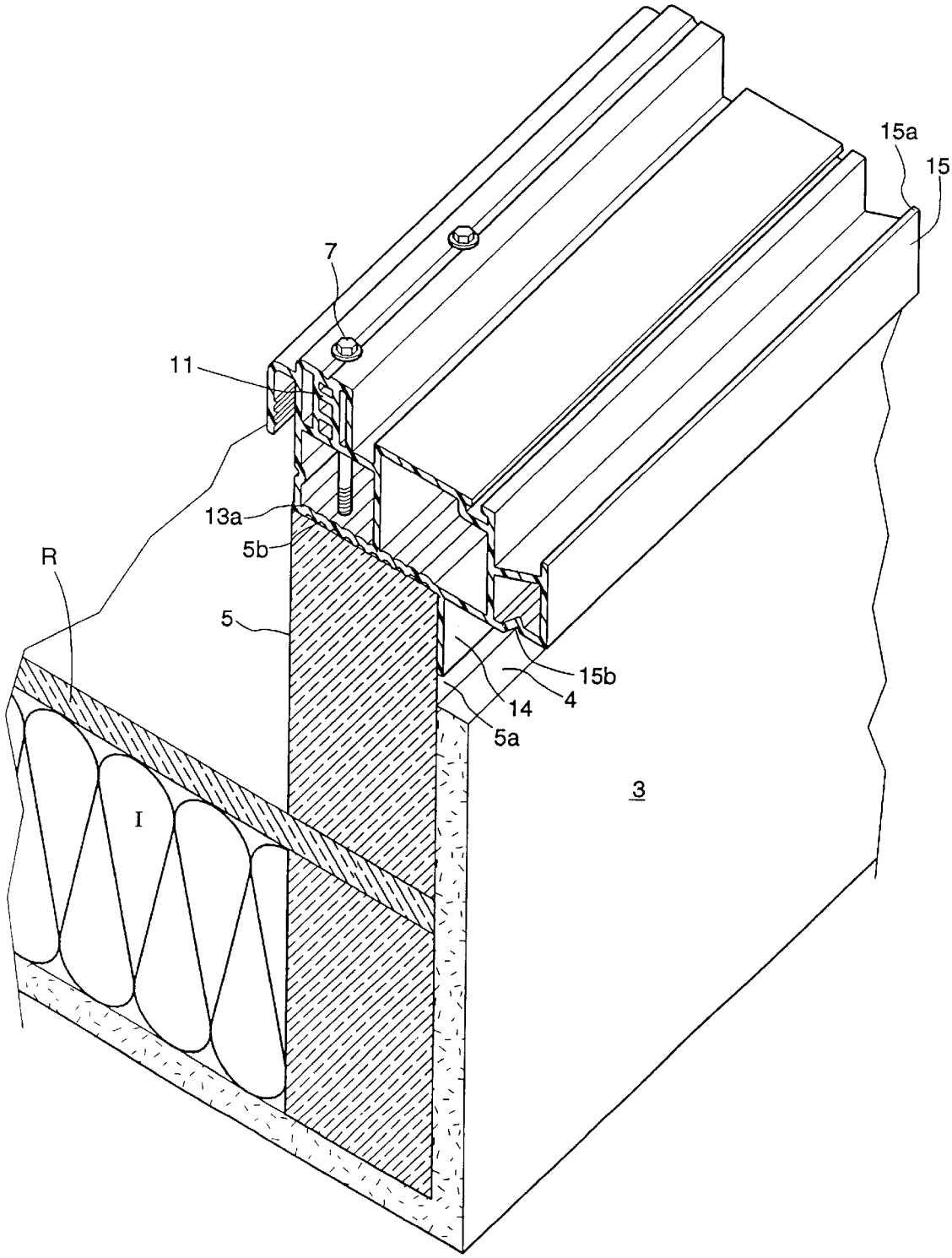
Figure 1C:
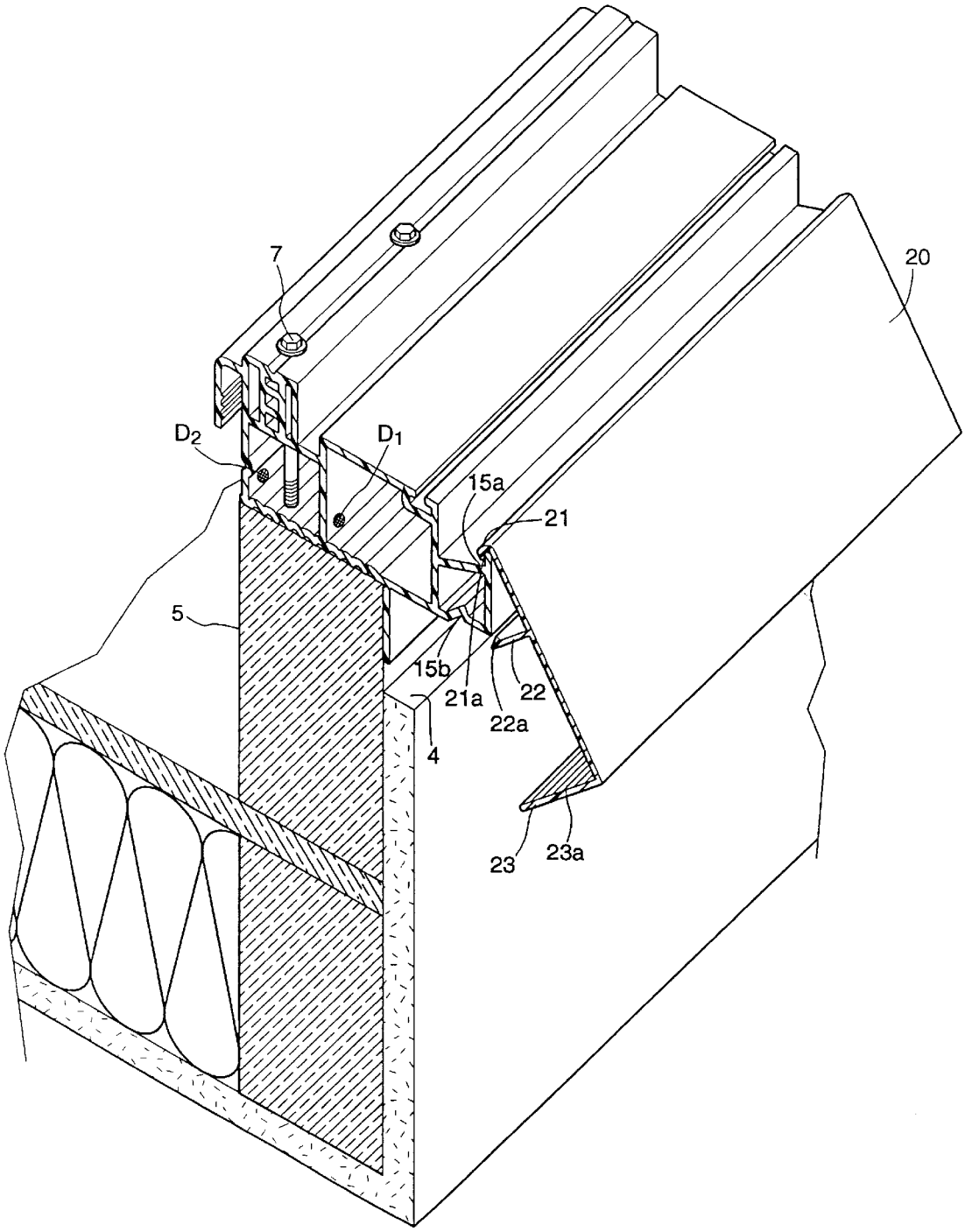
Figure 1D:
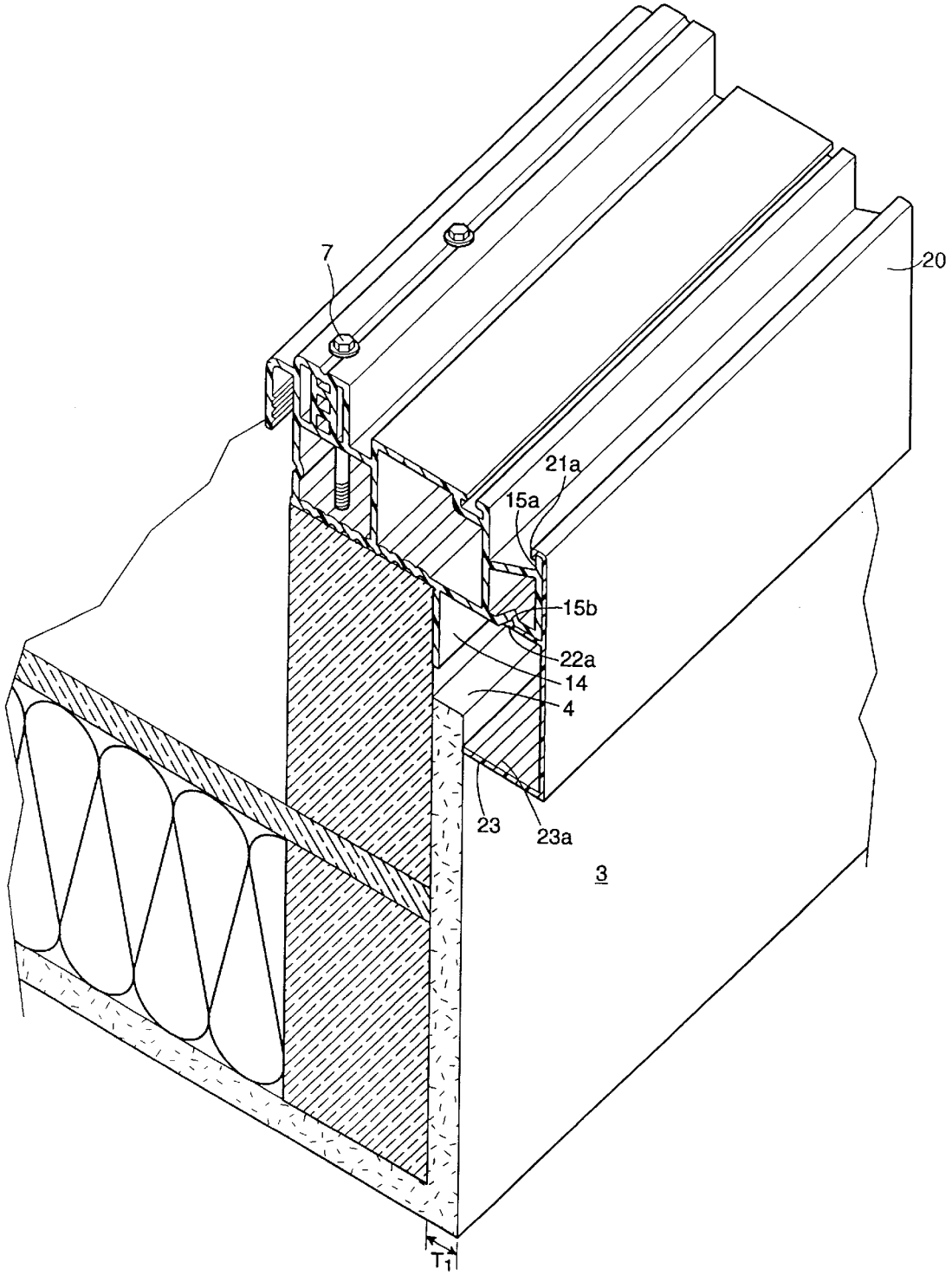
Figure 1E:
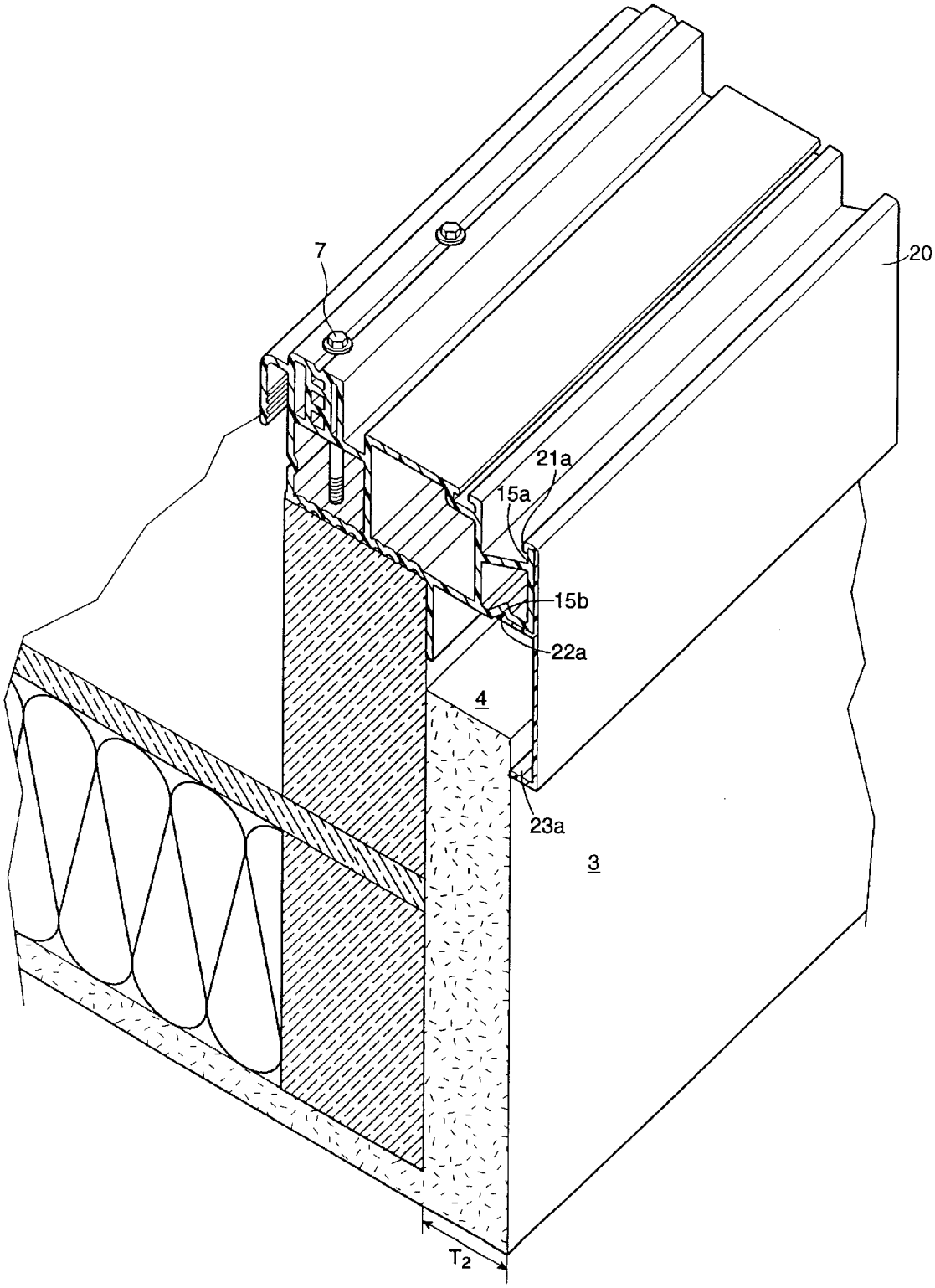
Figure 6:
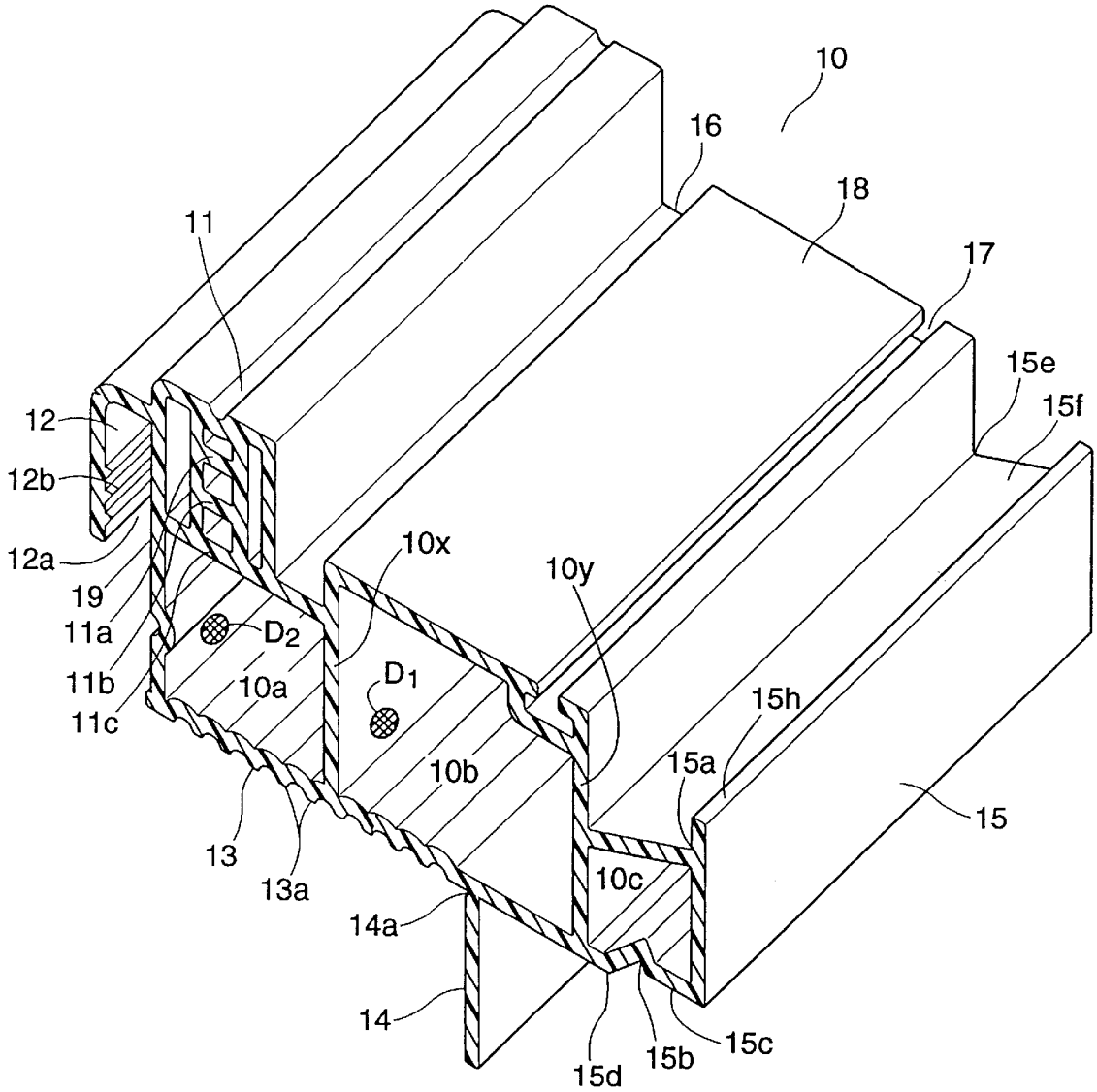
FIG. 6 is a perspective view of the low profile section of FIGS. 1A through 1E illustrated in the preferred embodiment of the invention.
Figure 9A:
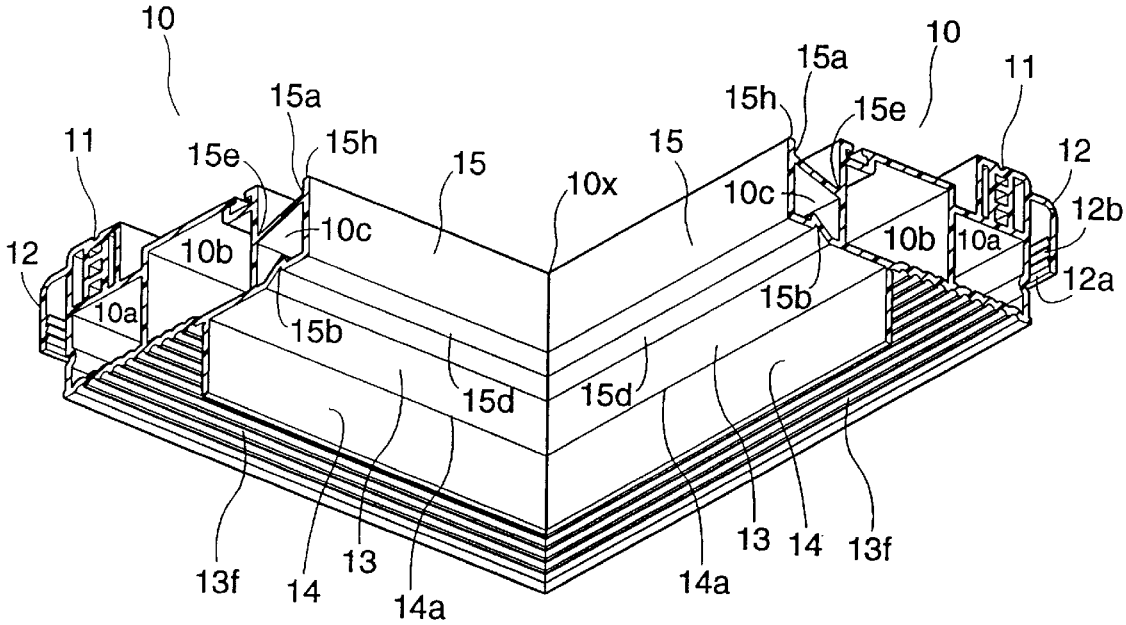
FIGS. 9A and 9B illustrate the interconnecting of the low profile sections of FIG. 1A through 1E illustrating the snap-on molding portion 20 and the manner in which the adjacent members 20 are interconnected and interfit.
Figure 9B:
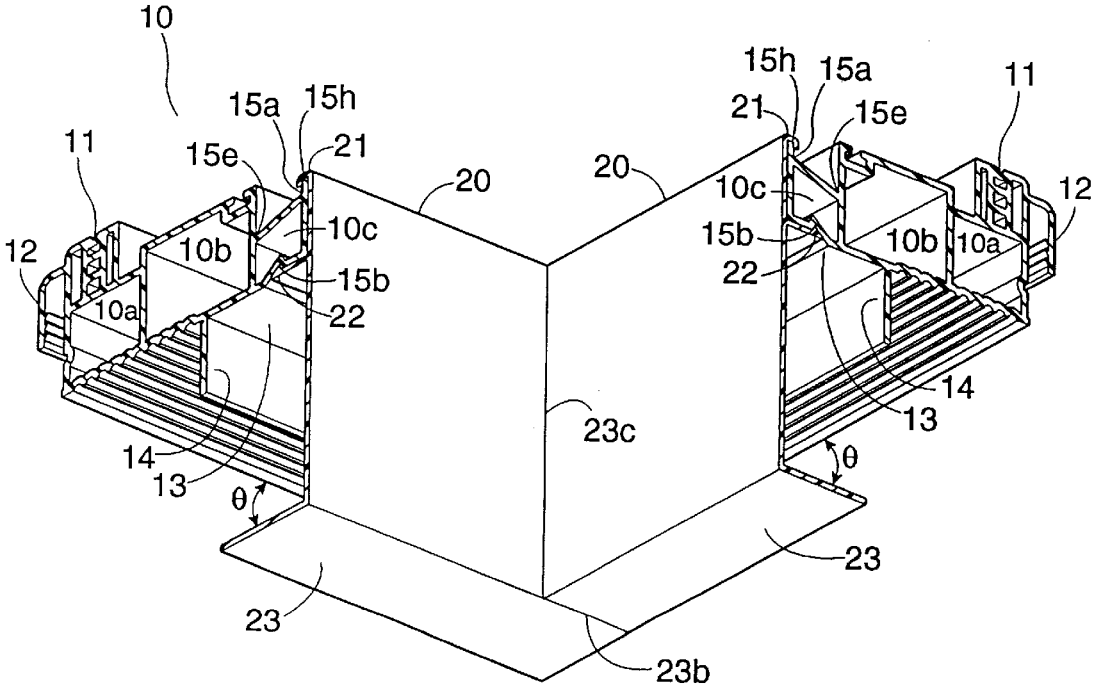

Referring now to FIGS. 1A through 1E there is illustrated a low profile section 10 for a skylight assembly. FIG. 9A illustrates how these sections would interfit. The section 10 therefore includes as best seen in relation to FIG. 6, three horizontally disposed spaces 10A, 10B and 10C interconnected by web portions 10X and 10Y. The section 10 has disposed proximate the top thereof an interior side 15, and an exterior side 19. The exterior side of the section 10 includes a generally inverted "J" shaped member 12 including a pocket 12A having a downwardly extending leg 12B having ribs disposed thereon for anchoring a flashing portion, (not illustrated), including a flexible seal to anchor said flashing. The top of the section 10 includes a screw port 11 separated by three webs 11A, 11B and 11C for receiving an anchoring screw 7 therethrough to anchor the bottom 13 including rib portions 13A with the curb 5 having a top and having a silicone like sealant 6 placed thereon. The portion 13A including the ribs and channels therefore will compress on the silicone 16 and aid to the adherence thereof on top of the curb 5. The top of the section 10 also includes an exterior drainage channel 16 and interior drainage channel 15E and a seal receiving channel 17. The surface 18 is for receiving the glass portion, not shown, (for compressing against the seal within seal receiving channel 17, the seal also not being shown). The glass is anchored with a separate generally "F" shaped aluminum cap which is generally "F" shaped in order to put any loading forces on this seal instead of the edge of the glass. The channel 15E represents an interior condensate channel for draining any interior condensation. The leg portion 15 includes a notch 15A and a edge 15H. The bottom of the leg 15 also includes a anchoring recess 15B separated by inclined ramp portions 15C and 15D. The combination of the edge 15H and the recess 15A and bottom recess 15B is for receipt of the snap-on or clip-on molding 20, as best seen in FIG. 1C and 1D and FIG. 9B. The molding 20 eliminates the debris area illustrated in FIG. 4 and labeled therein as "B". No such debris area may accumulate on edge 4 of the drywall 3 as a result. Heat losses are reduced as well. Disposed also proximate the bottom of the low profile 10 is a removable flange portion 14 which butts against surface 5A of the curb 5, if present, to assist in positioning the section and skylight assembly by the installer. The snap-on molding 20 therefore snaps in position as best seen in FIG. 1D wherein the intermediate leg 22 via the finger 22A engages the recess 15B while the arm 21 and the foot 21A engage the recess 15A proximate the top of the section. The horizontally disposed leg 23 includes the plurality of trimmable sections 23A to accommodate various thickness T1 of the drywall 3. In FIG. 1D the drywall has a thickness of T1 and therefore there is no trimming required for the flanges 23A. However, in FIG. 1E the drywall or wooden slat has a thickness T2 and such a thickness T2 may be accommodated by the molding 20 by trimming the excess portions 23A away leaving a smaller portion 23 to butt up against the face 3 of the drywall. As a result, the low profile section is anchored in position by the screw 7 and the silicon 6 disposed on the curb 5 and being positioned by the flange 14 with respect to the curb to allow an easy fit for the installer without the necessity of anchoring the flange portion 14 into the curb 5 by the roofer having to descend from the roof, enter the dwelling and place a ladder into the tunnel wherein the skylight will be anchored into the curb from below as is the case with the prior art installation of FIG. 4.

Referring to FIGS. 9A and 9B the supplementary molding portion 20 is anchored in position with the Figures being illustrated in perspective when viewing from the bottom of the tunnel. The sections 10 are therefore interconnected at l0X at a mitered joint which is ultrasonically or fusion welded as is known in the art. The ribbed portion shown on the bottom of the section 10 at 13 show the amount of ribbing which will engage the silicon 6 disposed on the curb. The curb 5 is not shown for simplicity sake. The supplementary molding 20 is notched at the butt joint 23C to allow for the lack of any interconnection, other than a silicon bead being required along the seams at 23C. No silicone is necessary for seam 23B, but it may be used regardless. The leg portions 23 are therefore formed at a angled theta of slightly less than substantially 90 degrees in order for a tension fit to be provided when the adjacent supplementary members 20 are interconnected and interfit with the assembly. When interfit the angles will revert to substantially 90 degrees and assist with the quality of the interfit of the members 20. As a result the skylight assembly manufactured from the low profile members 10 provides for a clean and an ascetically pleasing sanitary installation, unlike that installation of the prior art of FIG. 4. Further, by providing a multiplicity of adjustment trimming portions 23A, the installer has the ability to accommodate 1 and ½ inches of latitude in the installation should there be a variance in any measurements taken. The installer therefore does not have to be as precise with pre-installation measurements. In the prior art case when replacing a previous installation, the measurements must be fairly precise or the installer runs the risk of having to remanufacture the skylight, in that it may not fit the opening. In this situation, the installer may have standard size units which may accommodate variations from installation to installation. Further alternative lengths of supplementary moldings may be provided at 3 inch increments as desired.

Should the installer wish to provide an economical curbless installation for a sundeck, solarium or the like he may remove the flange or let 14 at 14A, utilizing the identical section. The supplementary molding would then be provided in various lengths to extend below the ceiling of a solarium, similar with regard to the installation of FIG. 3D utilizing the high profile section which will be described hereinafter. The generally "L" shaped molding would therefore include the leg portion for extending adjacent the ceiling covering any rough openings and metal edges, as well as exposed insulation.

Figure 2A:
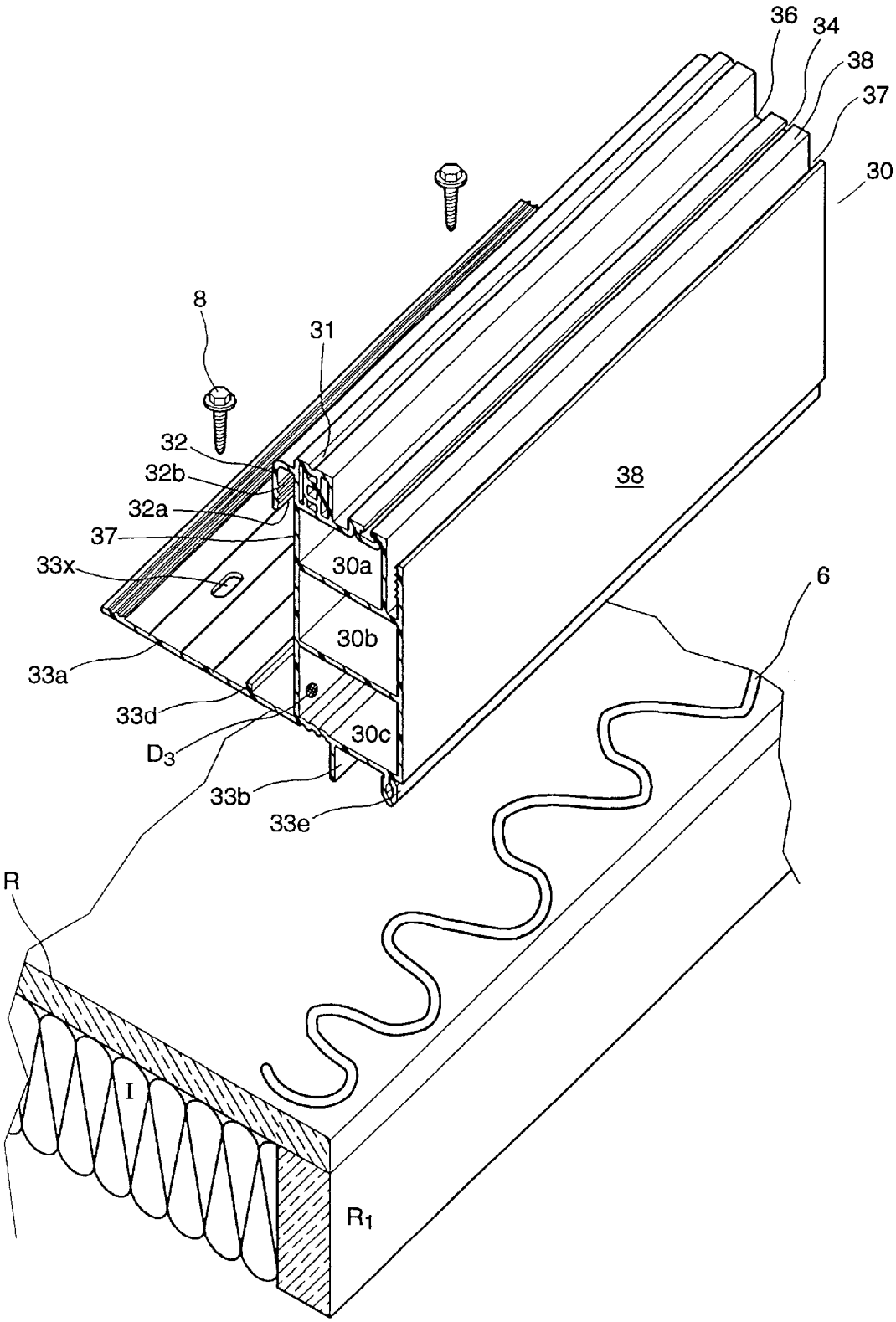
FIGS. 2A through 2D illustrate a high profile standardized framing section and the step by step installation thereof as a skylight assembly on the top of an enclosure without a preformed curb and illustrated in a preferred embodiment of the invention.
Figure 2B:
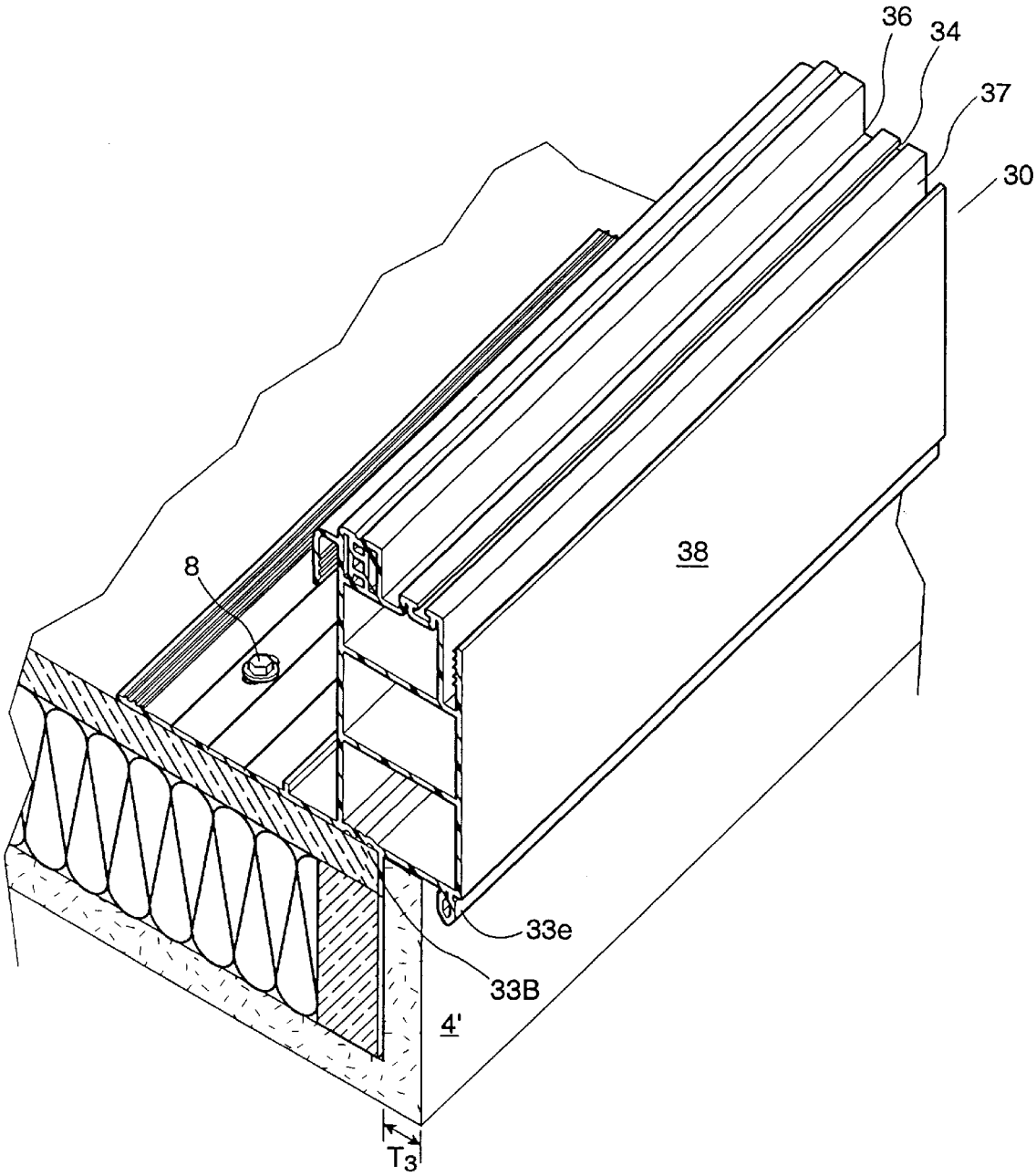
Figure 2C:
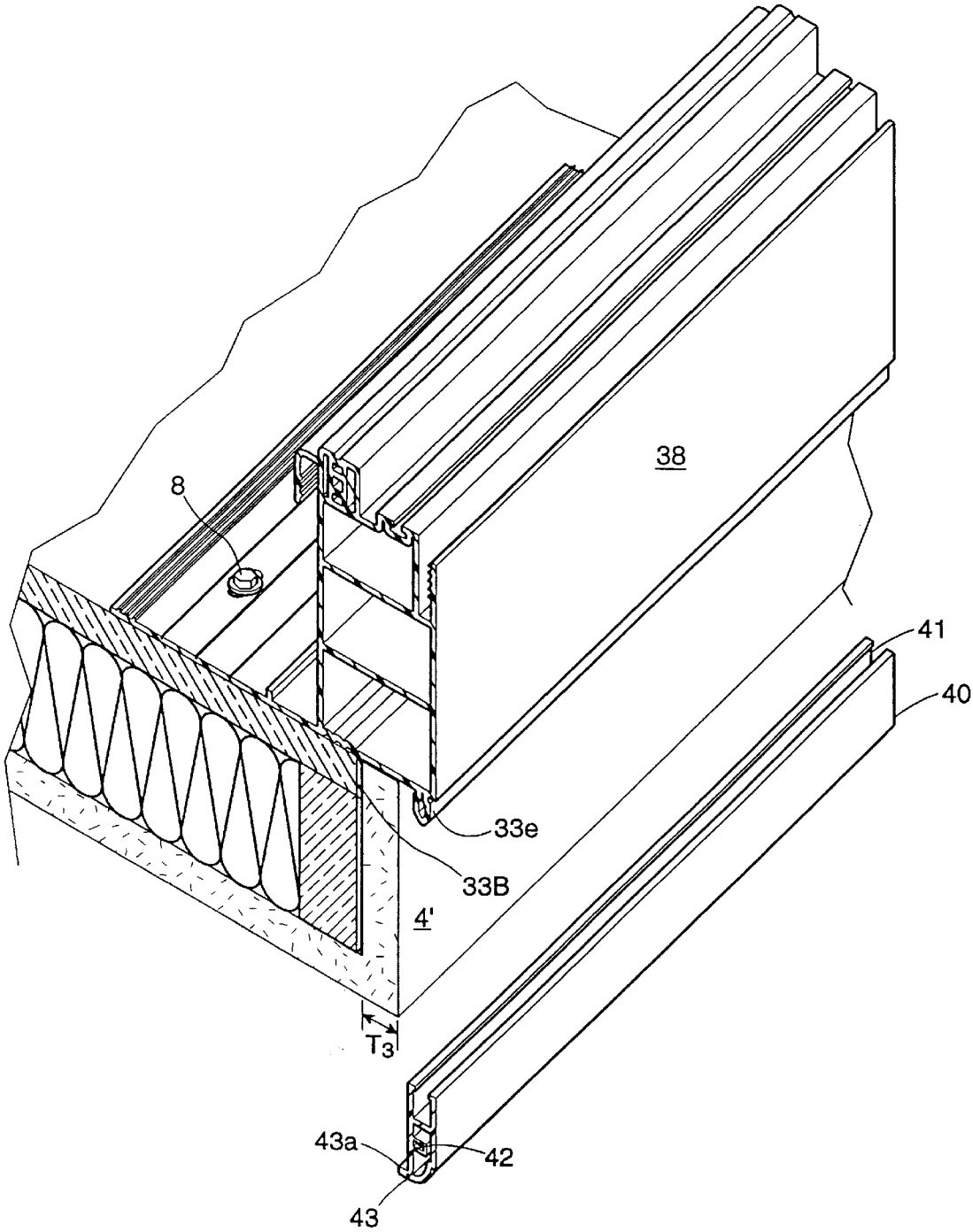
Figure 2D:
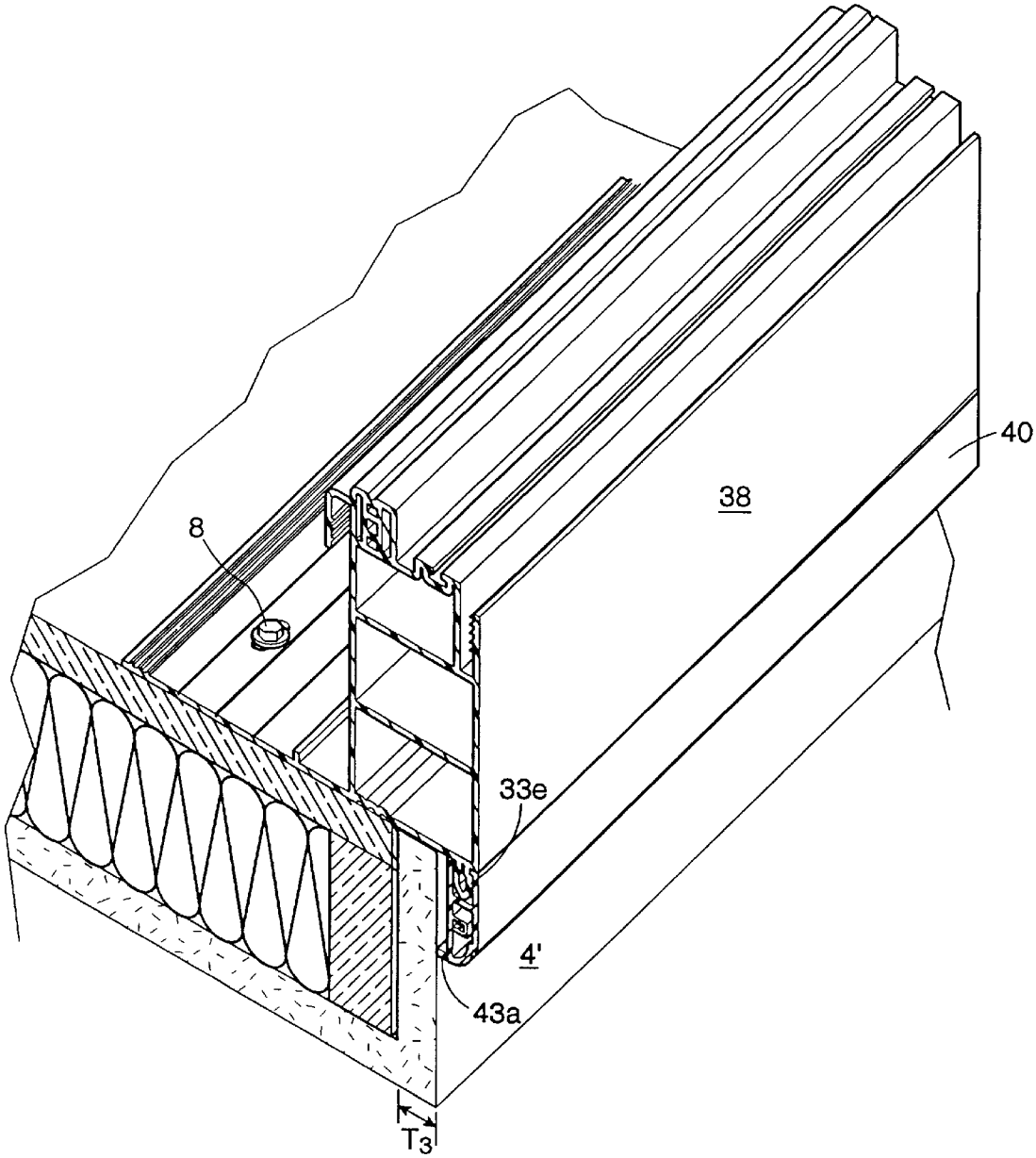
Figure 7:
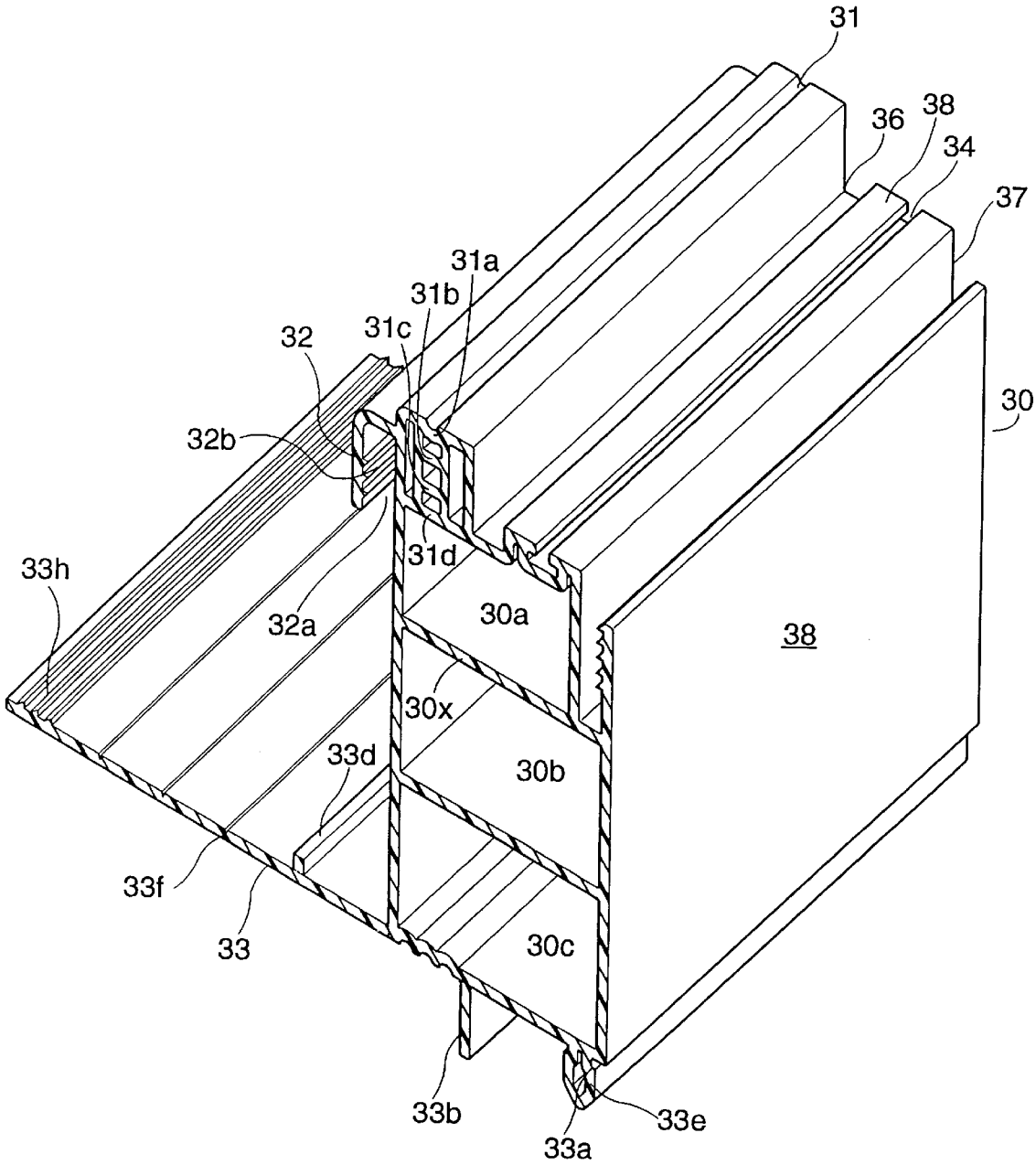
FIG. 7 is a perspective view of the high profile section of FIGS. 2A through 2D illustrated in a preferred embodiment of the invention.

Referring now to FIGS. 2A through 2D, and FIGS. 5A, 5B, 7, 8A and 8B there is illustrated a standardized high profile section including three vertically spaced sections 30A, 30B, 30C separated by web portions as shown in FIG. 7 and marked as 30X. The section 30 therefore includes a top, bottom, two sides and two ends. The ends are mitered together in a manner similar to that illustrated in relation to FIGS. 10A and 10B. The top of the section 30 includes a screw port 31, a glass receiving channel 38, a exterior condensate drainage channel 36, an interior drainage channel 37, and a flashing anchoring member 32. The high profile section 30 includes proximate the bottom of the side 37, a trimmable flange portion 33 including a multiplicity of trimming sections 33F which may be trimmed, for example in relation to the illustrations of FIGS. 8A and 8B. The trimmable flange 33 includes ports or openings 33X for receiving fasteners 8 for anchoring the high profile section 30 proximate the roof "R". This installation is without a curb so the sealant 6 is placed adjacent the opening, adjacent framing members R1 wherein the bottom 33A of the trimmable flange 33 includes a multiplicity of ribs to accept the silicone when the downwardly extending appendage 33B butts the drywall exterior surface as seen in FIG. 2B. The drywall 4' therefore having a thickness T3 is therefore covered proximate the top thereof to prevent the accumulation of the debris, unlike that as shown in FIG. 4, by a supplementary molding 40 shown in FIG. 2C including a screw port 42 should it be required (although it is not normally required), and a pocket 41 for engaging the downwardly extending thumb portion 33E disposed proximate the bottom of the extrusion 30 proximate the side 38 thereof. The pocket 41 therefore is for receipt of the thumb portion 33E which snap fits into the pocket 41 of the supplementary molding 40. The supplementary molding includes a bottom portion 43 including a removable tab 43A to accommodate variations in the thickness of the drywall or tunnel lining material such as wooden slats, the thickness being in FIG. 2C having a thickness of T3 in FIG. 2D and 5A having a thickness of T10 and in FIG. 5B having a thickness of T11 wherein the trimming appendage 43A is removed to thereby accommodate this variance. ⅛ inch adjustment therefore is available to the installer providing a total of ¼ inch from side to side and end to end for the installers convenience. The molding 40 could equally be replaced by any molding butting up against the drywall 4' in an accommodating manner to provide for this variation. No limitations as to the geometry of the supplementary member is implied, only that it clips or snaps into position or is fastened in like manner accomplishing the same objectives. The high profile section therefore provides a very clean, well sealed installation without the need for the installer to enter the dwelling to complete the installation. The entire installation may be completed from above. With the examples of FIGS. 1A through 1E the installation on the curb may be installed by a window installer from below utilizing the tab 14 to anchor to the curb 5, although it is preferred to install it from above.

Figure 3A:
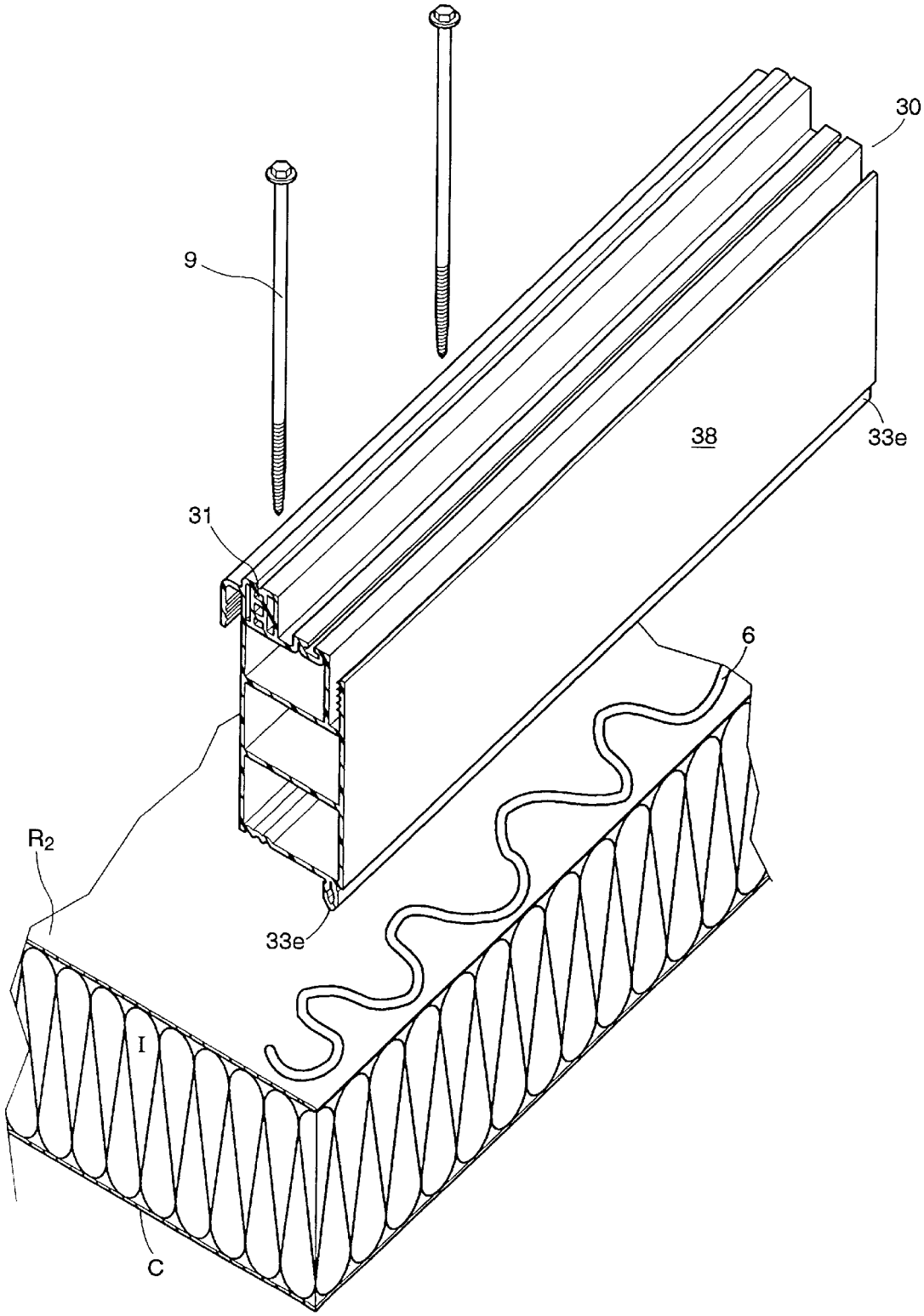
FIGS. 3A through 3D illustrate a modified high profile section for a skylight assembly shown being installed as a curbless installation in a sunroof, solarium or the like and illustrated in the preferred embodiment of the invention.
Figure 3B:
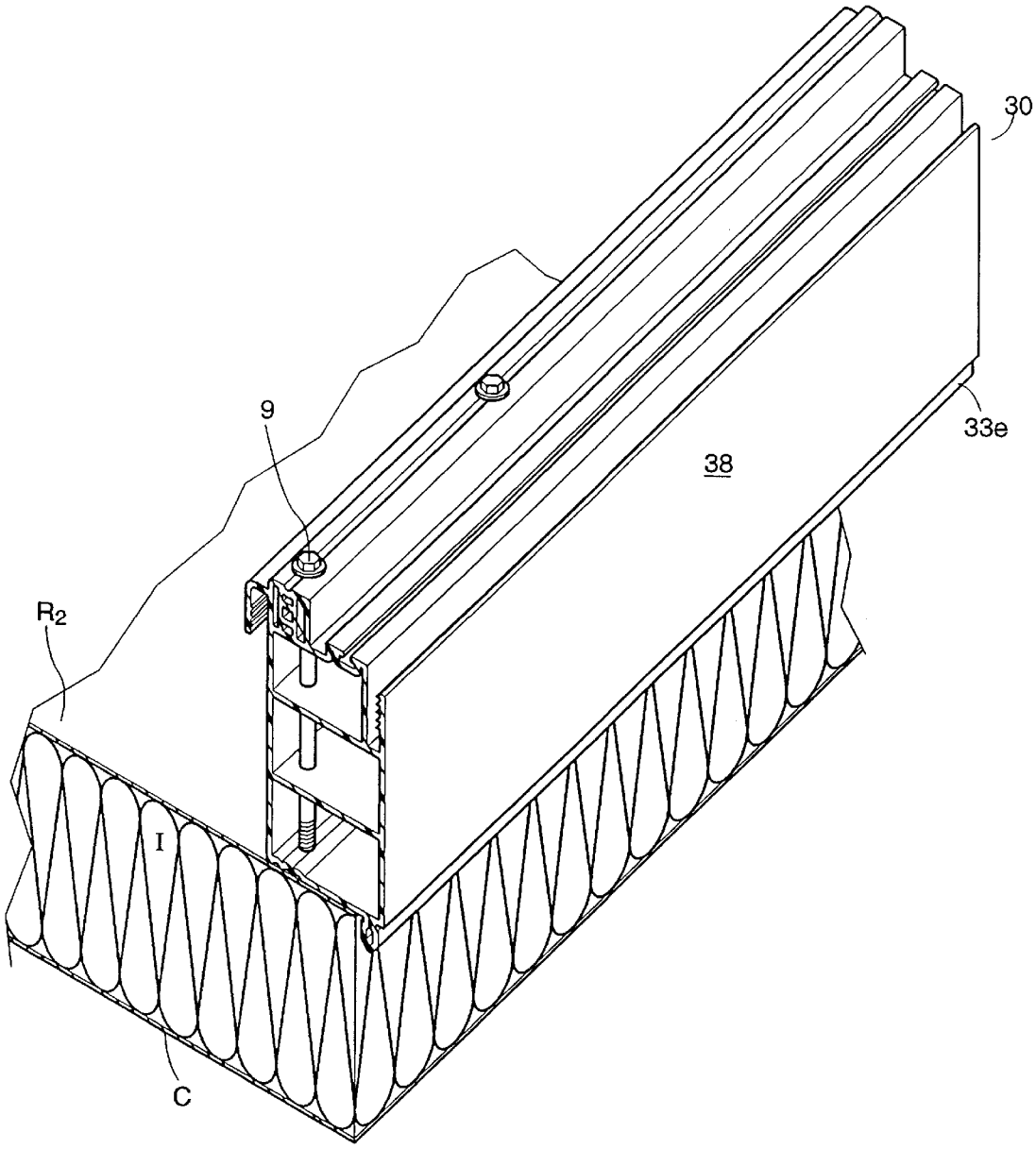
Figure 3C:
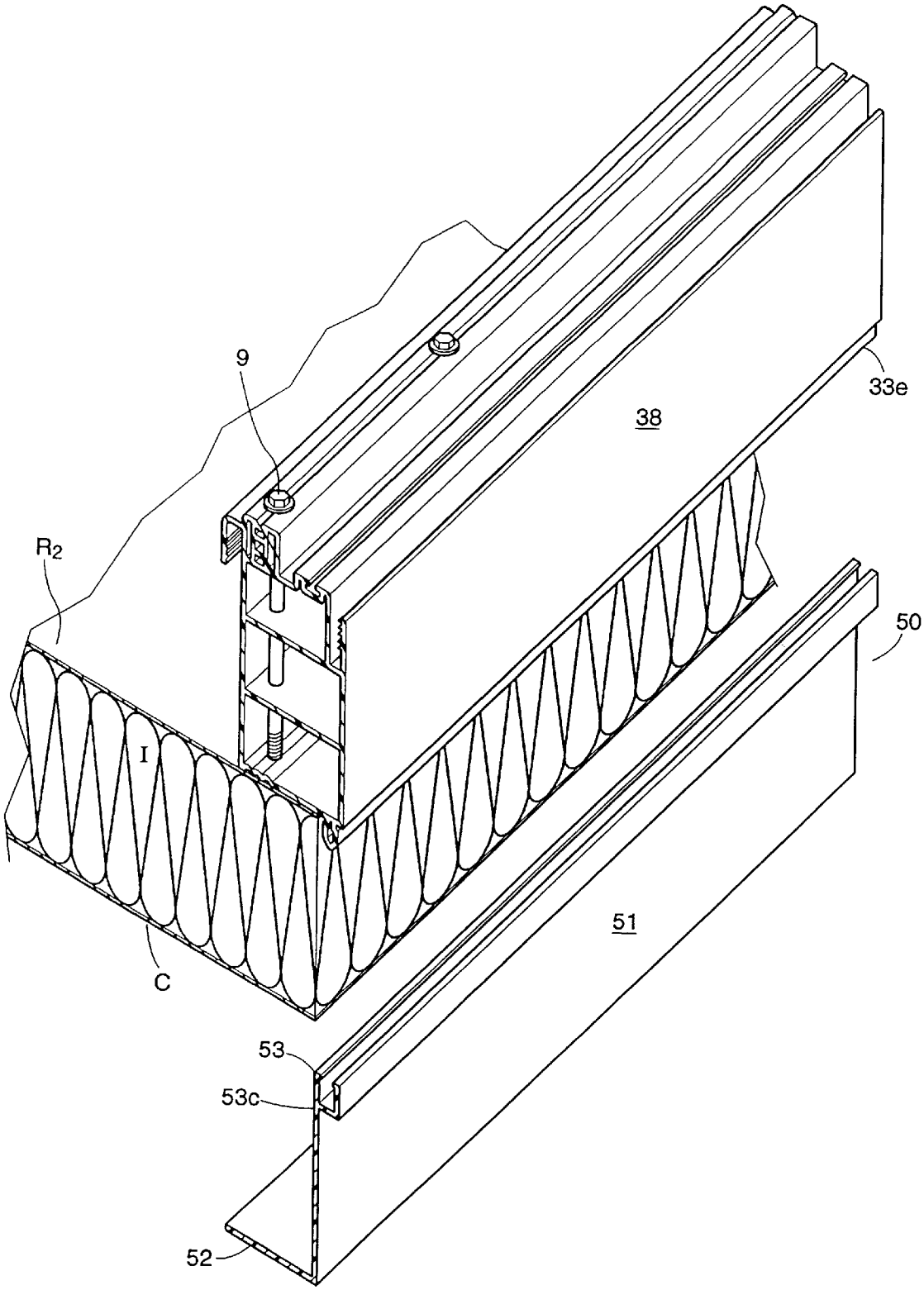

Referring now to FIGS. 3A, 3B, 3C and 3D there is illustrated the use of the standard profile sections previously described with the trimmable flange 33 being entirely removed allowing for the same section 30 to be utilized for a solarium having a roof "R2" and a under ceiling "C" with exposed installation "I" resulting from the rough cutting of an opening therethrough. The profile 30 therefore which is identical to the profile previously described, is therefore fastened to the top of the solarium, sun deck or the like via screws 9 through screw ports 31. The removable appendage 14 has also been trimmed in order to provide a flush mounting for the member 30 on the sealant "S" with the alternating grooves and ridges biting into the silicone 6. When therefore positioned as shown in FIG. 3B the downwardly extending thumb portion 33E extends on the side 38 of the section 30, clearing the insulation "I". Supplementary molding portion therefore labeled 50 as seen in FIG. 3C includes a pocket 53C adjacent to upwardly extending forked members creating a generally "U" shaped pocket 53C for receiving the thumb 33E as a snap in fitting. The installer merely has to tap the supplementary member 50 proximate the bottom thereof at flange 52 to thereby snap fit into position and eliminate the necessity of installing separate "C" or "U" shaped channels to cover over any exposed rough metal edges and insulation. As described in relation to FIG. 10A and 10B with regard to the high profile extrusion, the portion 50 may be formed with the leg 52 being slightly less than substantially 90 degrees when formed to provide a tension fit of like members when the full skylight assembly is installed using only silicone to interfit the adjacent members 50. The horizontal leg 52 may be trimmable if necessary. The resulting installation results in clean lines as well as an asthetically pleasing and sanitary result. When a home owner looks down on the installation, the trimmable flange would not be observable since it was removed, unlike that of a roof system wherein the shingles are interwoven with the flashing in accommodating the flange.

Figure 8A:
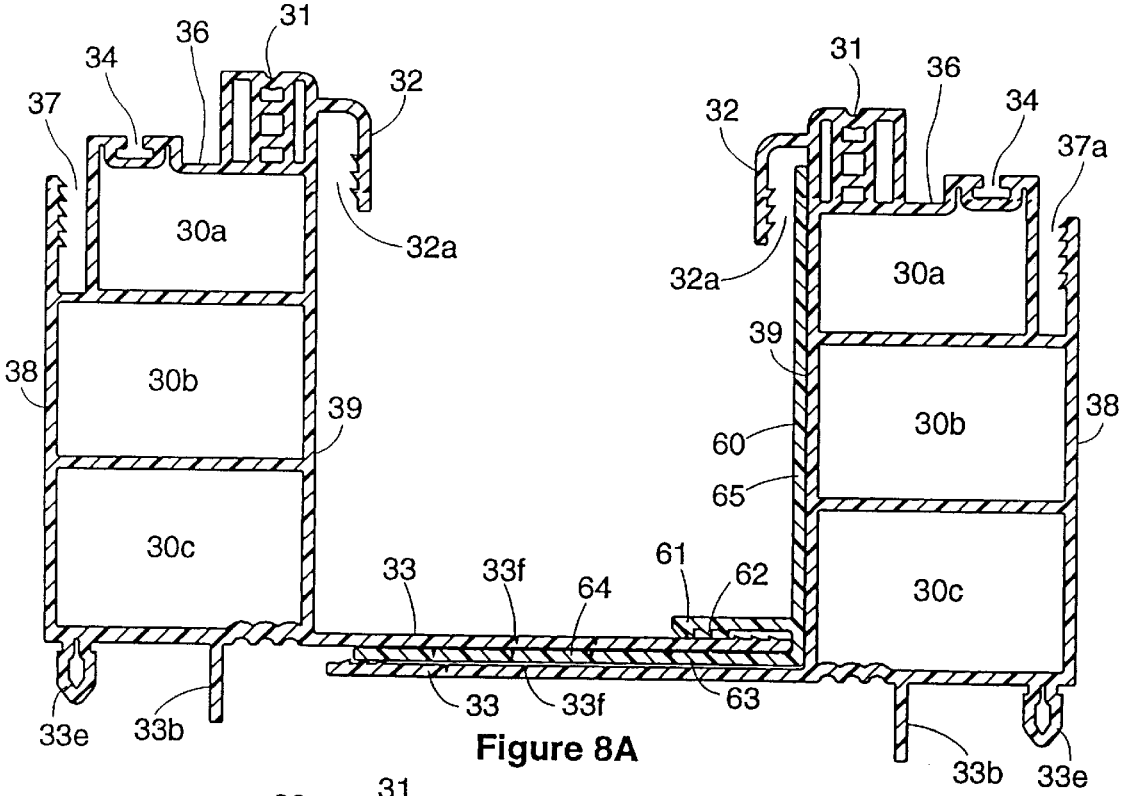
FIGS. 8A and 8B are sectional end views of the profile of FIG. 7 utilized in over and under installations illustrated in preferred embodiments of the invention.
Figure 8B:
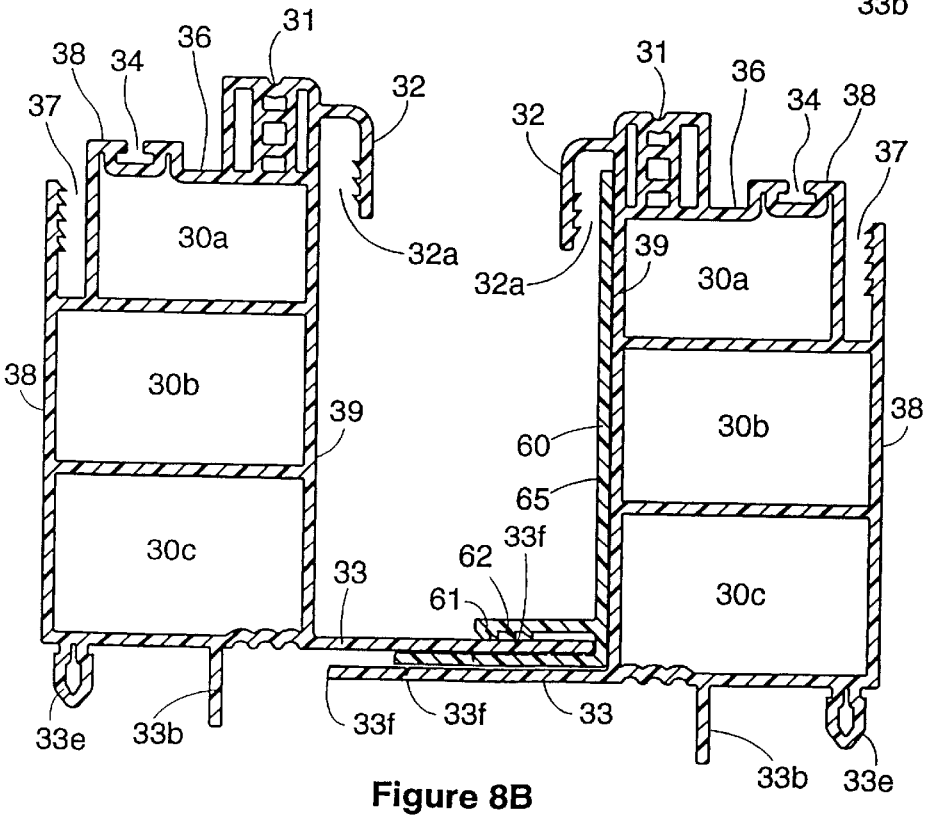

Referring now to FIGS. 7, 8A and 8B there is illustrated the standard high profile section as previously described with all of the components therefor including rib portions 33H and trimmable portions 33F proximate the trimmable flange 33. In FIGS. 8A and 8B there is illustrated two over and under installations illustrated in section schematically. Two skylights are therefore installed one above the other including the high profile section as shown with the flanges 33 extending towards one another. The supplementary interconnection portion 60 is therefore provided having a vertical leg 65 and a horizontal leg 63 and a smaller leg 61 including a pocket 62 for receiving the trimmable flange portion 33A of the section 30. The two skylight assemblies are therefore installed with the interconnection member being retained within the flashing anchoring portion 32 via a resilient seal (not shown) into the pocket 32A wherein the legs 63 and 61 capture there between within the pocket 62, the leg 33 of the member 30 shown to the left of the FIG. 8A. Trimming portions are provided at 64 which allow for the variation in the distance in which the skylight assemblies are separated, as shown in FIG. 8A and 8B. The trimmable flange 33 is also trimmed at trimming locations 33F to accommodate the variations in dimensions. Otherwise the installations are as described previously. Of course, it is popular to have a multiplicity of skylights in various rows and columns being installed in sunrooms and roofing systems. For simplicity sake only two have been illustrated. The exact same interconnecting member is utilized in all cases thereby providing a generally "U" shaped drainage channel provided by side portions 39 interconnecting member vertical leg 65 and bottom portion 33 and 61.

Figure 3D:
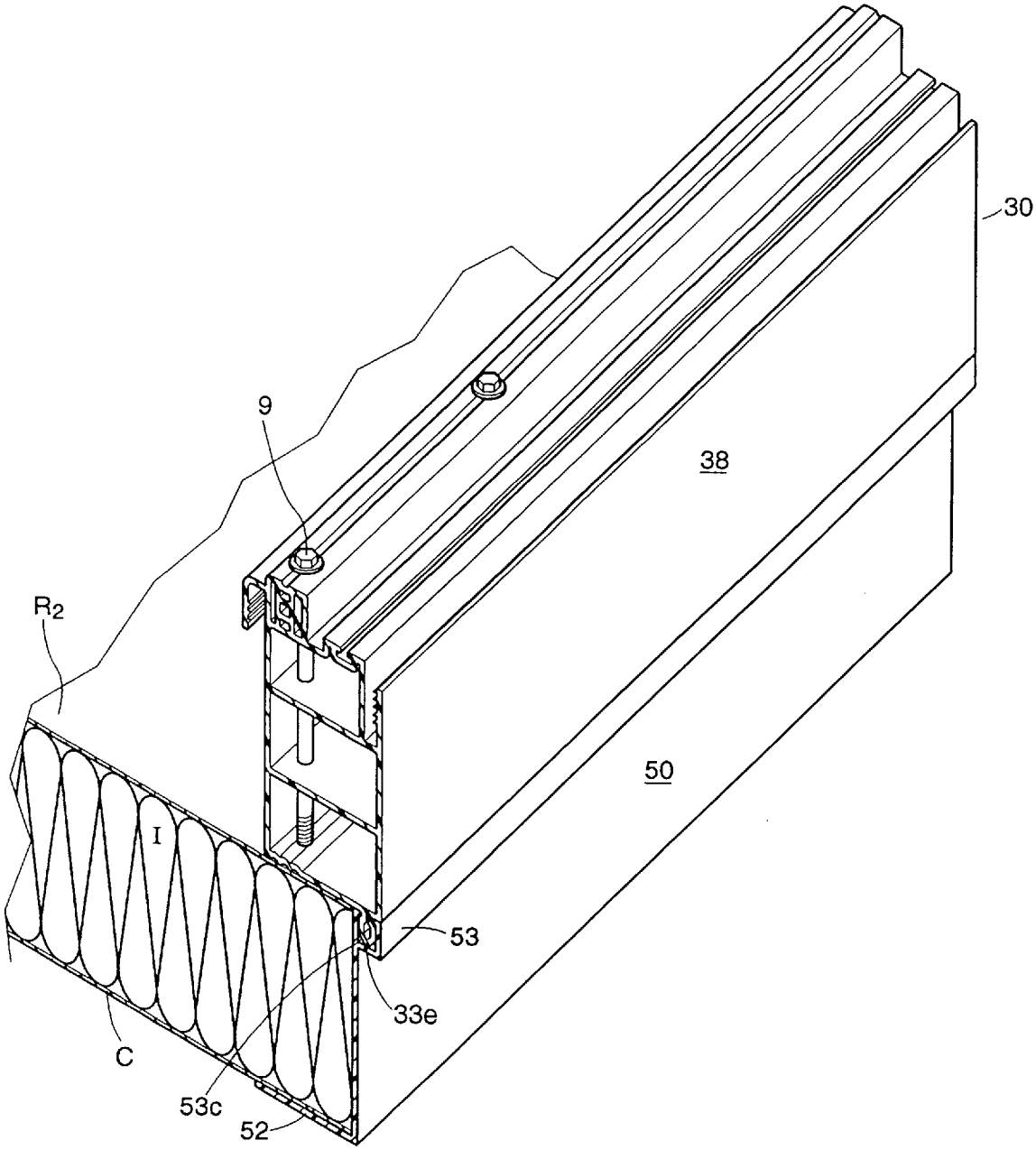
Figure 10A:
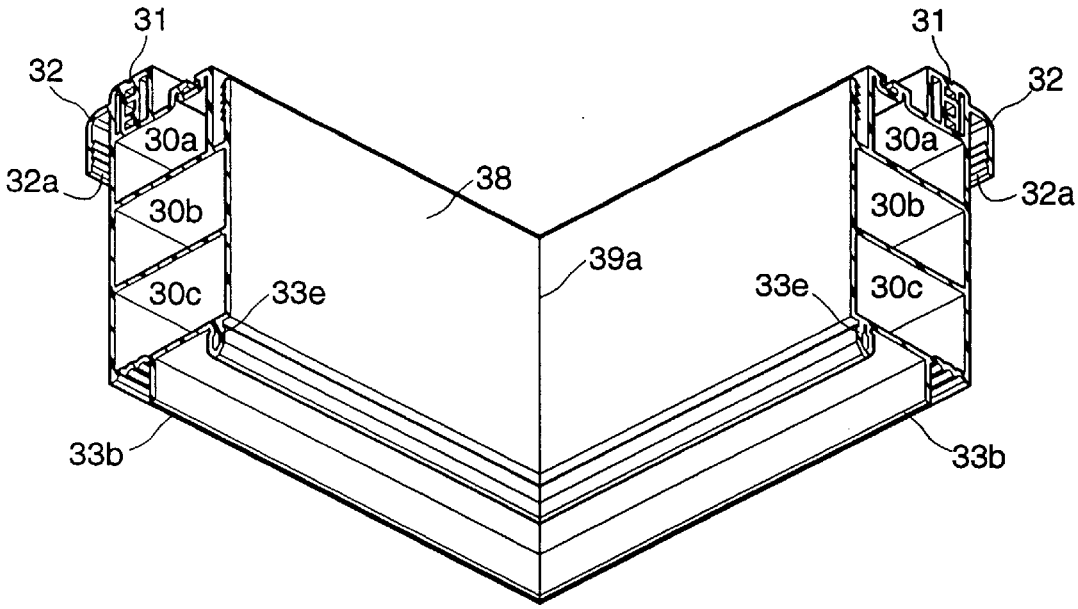
FIGS. 10A and 10B illustrate the interconnecting of the high profile sections of FIGS. 2A through 2D illustrating the snap-on molding portion and the manner in which adjacent members are interconnected and interfit.
Figure 10B:
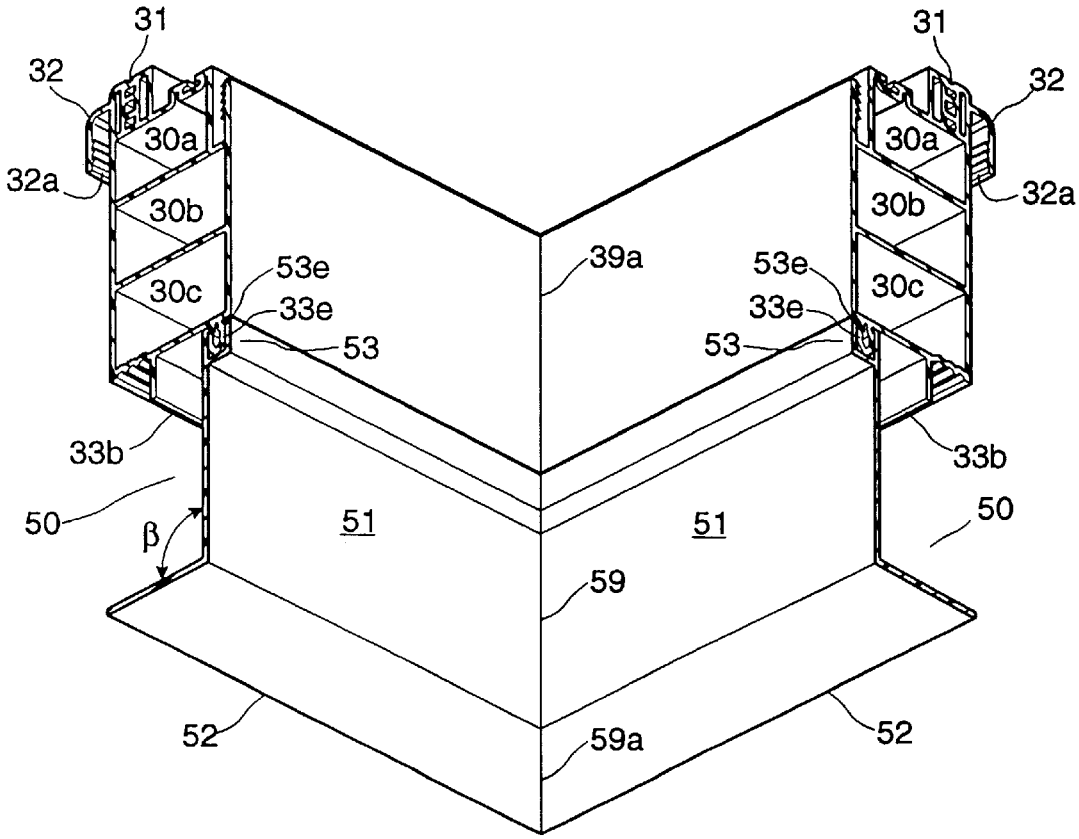

Referring now to FIGS. 10A and 10B, there is illustrated the extrusion of profile of FIGS. 3B through to FIGS. 3D assembled in the manner illustrated in those Figures, illustrating the manner in which the supplementary molding 50, is snapped into position on the thumb 33E of the extrusion 30 as previously described. The mating extrusions jointed at the mitered joint 39A which may be joined by conventional methods including silicone and ultrasonically or fusion welding. The supplementary members 50 are not welded together. They are mitered at the union 59 and 59A with a bead of silicone being placed at joint 59 and as desired by the installer at 59A. It is not absolutely necessary at 59A, but of course it will improve the quality of the installation. A flange 52, as previously described, extends at slightly less than substantially 90 degrees at an angle beta from the vertical wall 51 of the molding 50. When the moldings are brought together at the mitered joints 59 and 59A, the angle beta which is slightly less than 90 degrees becomes substantially 90 degrees providing for a tension fit of the flanges making up the supplementary moldings 50 where they join. In this manner the interfit is substantially improved.

Drainage is accommodated via drainage ports D1, D2, and D3 as is well known.

It is not intended that the above descriptions in any way limit the manner in which the supplementary moldings may be utilized or the manner in which they snap on or are alternatively fastened. It is only necessary that the low and high profile sections include within their geometry a appendage such as interlocking, anchoring portions 15B and 15A for the low profile section, the portion 15B being separated by ramps 15C and 15D and the portion 15A being disposed below leg 15H and a ramp extending down toward the edge 15E. This is one example of the type of snap-on available. The thumb portion 33E is another example of the type of snap-on which might occur. By reversing the portions 33E and portion, for example, 41 that is a channel being disposed on the extrusion and a thumb being disposed on the snap-on fitting, it would work equally as well. No limitations are therefore implied.

While the foregoing provides a detailed description of preferred embodiments of the invention, it is to be understood that this description is illustrative only of the principles of the invention and is not meant to be restrictive. Furthermore, as many changes can be made to the invention without departing from the scope of the invention, it is intended that all material contained herein be interpreted as illustrative of the invention and not in a limiting sense.

The embodiments of the invention in which an exclusive property or privilege is claimed are as follows:

1. A skylight for installation in an opening disposed in a top of an enclosure comprising framing sections adapted for installation adjacent the opening, said sections providing for variation in installations and accommodating on site adjustments when fastening and fitting the skylight within the opening of the enclosure, said framing sections having disposed therewith snap on molding engaging portions and being adapted to receive supplementary snap on moldings adapted to engage with the snap on molding engaging portions of the framing section which provides for variation in installation tolerances resulting from installation of said skylight, accommodating on site adjustments.

2. The skylight of claim 1 wherein the moldings are generally "F" shaped in cross section having a leg being trimmable at several positions along the leg to accommodate various thicknesses of material forming a tunnel within the enclosure adjacent said opening.

3. The skylight of claim 1 wherein the moldings are generally "L" shaped in cross section for abutting aluminum sheeting proximate a bottom of a solarium ceiling, and covering any exposed rough edges of the ceiling.

4. The skylight of claim 1 wherein the molding is generally "J" shaped in cross section and includes a trimmable flange to allow for variation in thickness of material forming a tunnel within the enclosure adjacent said opening.

5. A skylight assembly comprising a main frame for surrounding an opening in a top of an enclosure, such as a "roof" of a dwelling or solarium, said enclosure separating an interior space and an exterior, and having a top, said opening extending from the exterior into the interior space of the enclosure, said main frame including at least one main frame section having a top, a bottom, a first exterior side and a second interior side and two ends, said top of said section for receiving and securing a glass light said bottom of said section for securing to adjacent the top of the enclosure adjacent the opening said top of said section including; a screw port for receiving a fastener, a glass receiving channel, an exterior condensate receiving channel located proximate the first exterior side, an interior condensate receiving channel located proximate the second interior side; the bottom of said frame section having a removable leg provided therewith extending downwardly away from said frame section for abutting one side of the material within a tunnel forming the opening, the main frame section also having a supplementary molding engaging portion disposed proximate the second interior side of the main frame section, said supplementary molding engaging portion for receiving a snap on supplementary molding adapted to friction fit with the supplementary molding engaging portion of the framing section for engaging and abutting an opposite interior surface of the material engaged by said removable leg, wherein said skylight assembly accommodates for variations from one installation to another.

6. The skylight assembly of claim 5 wherein said main frame section has a flashing anchoring member disposed proximate the top thereof proximate the first exterior side.

7. The skylight assembly of claim 5 or 6 wherein a removable flashing portion is disposed proximate the bottom of the first exterior side, said removable flashing portion being removed when the skylight is installed without a curb thus providing an aesthetically more pleasing installation.

8. The skylight assembly of claim 5 wherein the supplementary molding engaging portion is disposed proximate the top thereof and the frame section has a low profile and includes at least two interconnected horizontally disposed subsections.

9. The skylight assembly of claim 5 wherein the supplementary molding engaging portion is disposed proximate the bottom thereof and the frame section has a high profile of at least two interconnected vertically disposed subsections.

10. The skylight assembly of claim 5, wherein said supplementary molding has a trimmable flange to accommodate variations in dimensions of material providing for on site adjustment to variations in wall thickness.

11. The skylight assembly of claim 5 wherein the supplementary moldings are selected from one of the group of generally "F", "L" or "J" shaped moldings.

12. The skylight assembly of claim 5 wherein the supplementary moldings also include a trimmable appendage extending therefrom to allow for variations in installations.

13. The skylight assembly of claim 11 wherein the supplementary moldings are flexible and therefore flex from an angle of slightly less than substantially ninety degrees, to an angle of about ninety degrees.

14. The skylight of claim 1 or 5 further comprising a first and second skylight disposed above and below one another on a roof comprising a separate generally "L" shaped interconnecting member having a vertical and a horizontal leg and having a smaller leg extending substantially parallel and adjacent to the horizontal leg, said member abutting the exterior of the first skylight proximate a trimmable flange adjacent the bottom of the exterior side, and the second skylight interlocking with the first skylight when the trimmable flange adjacent the bottom of the exterior side of the second skylight is disposed between the smaller leg and the horizontal leg of the interconnecting member.

15. An interconnecting member for interconnecting a first and second skylight disposed above and below one another on a roof comprising a generally "L" shaped interconnecting member having a vertical and a horizontal leg and having a smaller leg extending substantially parallel and adjacent to the horizontal leg, said member abutting an exterior of a first skylight proximate a trimmable flange adjacent a bottom of an exterior side, and the second skylight interlocking with the first skylight when the trimmable flange adjacent the bottom of the exterior side of the second skylight assembly is disposed between the smaller leg and the horizontal leg of the interconnecting member.

* * * * *